US011920271B2

(12) United States Patent
Gnadeberg et al.

(10) Patent No.: US 11,920,271 B2
(45) Date of Patent: Mar. 5, 2024

(54) LAUNDRY TREATMENT APPLIANCE WITH CONFIGURABLE USER INTERFACE

(71) Applicant: Electrolux Appliances Aktiebolag, Stockholm (SE)

(72) Inventors: Hugo Gnadeberg, Stockholm (SE); Paolo Quattrin, Porcia (IT); Luca Da Re, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 393 days.

(21) Appl. No.: 17/268,531

(22) PCT Filed: Aug. 28, 2019

(86) PCT No.: PCT/EP2019/072946

§ 371 (c)(1),
(2) Date: Feb. 15, 2021

(87) PCT Pub. No.: WO2020/043769

PCT Pub. Date: Mar. 5, 2020

(65) Prior Publication Data

US 2021/0310172 A1 Oct. 7, 2021

(30) Foreign Application Priority Data

Aug. 30, 2018 (EP) ..... 18191671
Mar. 27, 2019 (EP) ..... 19165531

(51) Int. Cl.
*D06F 34/04* (2020.01)
*D06F 23/02* (2006.01)
(Continued)

(52) U.S. Cl.
CPC ..... *D06F 34/04* (2020.02); *D06F 23/02* (2013.01); *D06F 33/37* (2020.02); *D06F 39/02* (2013.01);
(Continued)

(58) Field of Classification Search
None
See application file for complete search history.

(56) References Cited

U.S. PATENT DOCUMENTS

2010/0006593 A1 1/2010 Hellweg
2010/0287709 A1* 11/2010 Doyle ..... D06F 33/32 68/12.18
(Continued)

FOREIGN PATENT DOCUMENTS

EP 2602378 A1 6/2013
GB 2311767 A 10/1997
WO 2011029766 A1 3/2011

OTHER PUBLICATIONS

WO 2011/029766 Water-Conducting Household Appliance Comprising Multiple Dosage Receptacles translation (Year: 2011).*
(Continued)

*Primary Examiner* — Cristi J Tate-Sims
(74) *Attorney, Agent, or Firm* — Bradley Arant Boult Cummings LLP

(57) ABSTRACT

A laundry treatment appliance having at least one compartment adapted to contain multiple doses of a treatment agent; at least one metering device adapted to draw up from the compartment at least one treatment agent dose to be delivered to a laundry load to be treated during a laundry treatment cycle; a user interface having at least one input selector for user selection of at least one treatment agent management function that affects the drawing up of the at least one treatment agent dose by the at least one metering device, and a communication interface for allowing a communication relationship between the laundry treatment appliance and an external user device, the communication interface being configured to receive from the external device enablement commands enabling the at least one input selector to allow the user selection of the at least one treatment agent management function.

20 Claims, 8 Drawing Sheets

(51) Int. Cl.

| | |
|---|---|
| ***D06F 33/37*** | (2020.01) |
| ***D06F 39/02*** | (2006.01) |
| *D06F 101/00* | (2020.01) |
| *D06F 101/20* | (2020.01) |
| *D06F 103/00* | (2020.01) |
| *D06F 105/42* | (2020.01) |
| *D06F 105/58* | (2020.01) |

(52) U.S. Cl.
CPC ..... *D06F 39/022* (2013.01); *D06F 2101/00* (2020.02); *D06F 2101/20* (2020.02); *D06F 2103/00* (2020.02); *D06F 2105/42* (2020.02); *D06F 2105/58* (2020.02)

(56) References Cited

U.S. PATENT DOCUMENTS

| | | | | |
|---|---|---|---|---|
| 2016/0312396 | A1* | 10/2016 | Cruickshank | G06F 3/0488 |
| 2017/0027410 | A1* | 2/2017 | Stoyanov | A47L 15/0055 |

OTHER PUBLICATIONS

International Search Report and Written Opinion for International Application No. PCT/EP2019/072946, dated Nov. 18, 2019, 8 pages.

* cited by examiner

LAUNDRY TREATMENT APPLIANCE WITH CONFIGURABLE USER INTERFACE

This application is a U.S. National Phase application of PCT International Application No. PCT/EP2019/072946, filed Aug. 28, 2019, which claims the benefit of European Application No. 18191671.9, filed Aug. 30, 2018 and European Application No. 19165531.5, filed Mar. 27, 2019, all of which are incorporated by reference herein.

FIELD OF THE INVENTION

The present invention generally relates to the field of laundry treatment appliances (hereinafter, concisely, "laundry appliances"), and particularly to laundry appliances for treating, e.g. washing, items (such as linen, clothes, garments, shoes, and the like), such as laundry washing appliances and laundry washing appliances also implementing laundry drying functions (also referred to as washers/dryers). More particularly, the present invention relates to a laundry appliance with improved functionalities and with improved user interface configurability.

BACKGROUND OF THE INVENTION

A laundry appliance typically comprises a drawer having drawer compartments for containing one or more laundry treatment agents (hereinafter, concisely, "treatment agents").

In an increasingly common type of laundry appliance, the drawer comprises one or more compartments each one adapted to contain multiple doses of a respective treatment agent for performing multiple treatment cycles (hereinafter referred to as multi-dose compartments): just as an example, in case of two multi-dose compartments, a multi-dose compartment may be arranged to contain multiple doses of a liquid washing detergent, whereas the other multi-dose compartment may be arranged to contain multiple doses of a liquid softener.

In this class of laundry appliance, the laundry appliance may implement an auto-dosing functionality in which, at each treatment cycle (and when the auto-dosing functionality is activated), a predetermined amount of treatment agent (usually referred to as treatment agent dose) is automatically taken from the multi-dose compartment(s) (e.g., by means of one or more pump devices associated therewith) and dispensed to a treatment chamber (such as a washing tub).

SUMMARY OF INVENTION

The Applicant has realized that the typical laundry appliances implementing the auto-dosing functionality are not satisfactory in that they lack of versatility.

Indeed, the automation degree offered by the typical laundry appliances implementing the auto-dosing functionality cannot be efficiently customable in order to respond to specific habits of the users.

For example, a laundry appliance having a first multi-dose compartment arranged to contain only multiple doses of a liquid washing detergent and a second multi-dose compartment arranged to contain only multiple doses of a liquid softener, is not suited for a user which is used to wash laundry without employing softener products: in this case, the second multi-dose compartment is left always empty and never used, whereby it is not possible to fully exploit the automation capabilities offered by the auto-dosing functionality.

Moreover, in such a laundry appliance, the user is forced to always use the same type of washing detergent stored in the first multi-dose compartment for different treatment cycles as long as there is still washing detergent stored in said first multi-dose compartment. If instead the user wanted to change washing detergent for a single treatment cycle (for example, for using a specific delicate washing detergent for performing a delicate treatment cycle when the first multi-dose compartment is still containing one or more doses of a washing detergent not suitable for washing delicate laundry), the user would be forced to manually empty the first multi-dose compartment to remove the previous washing detergent and manually substituting it with the new detergent.

In addition, the typical laundry appliances implementing the auto-dosing functionality are not capable of taking into consideration that some users would like to be able to adjust the treatment agent dose (e.g., according to a soil level of the laundry load or merely based on their own experiences or feelings or habits) whereas some other users would not care about this option/possibility.

The applicant has understood that there is the need to provide additional treatment agent management functionalities able to respond to the specific user habits.

However, the Applicant has also understood that, in doing so, the laundry appliance would feature an excessive number of functionalities and/or options selectable by the user: this large number of functionalities and/or options would negatively reflect on an appearance and structure of a user interface of the laundry appliance.

Indeed, the resulting user interface would feature additional input selectors for allowing selection of the additional treatment agent management functionalities, whereby these additional input selectors, together with the input selectors already provided for allowing selection of other (e.g., basic) functionalities and/or options, would determine a crowding of input selectors on the user interface. Such an input selector crowding could be difficult to understand to the user, and could make user experience even more frustrating.

In view of the above, it is an object of the present invention to provide a laundry appliance able to overcome these, as well as other, drawbacks, and particularly it is an object of the present invention to provide a laundry appliance equipped with improved treatment agent management functionalities adapted to be selected by the user in a versatile, flexible, easy and customizable way.

One or more aspects of the present invention are set out in the independent claims, with advantageous features of the same invention that are indicated in the dependent claims.

An aspect of the present invention relates to a laundry treatment appliance.

The laundry treatment appliance comprises:

- at least one compartment adapted to contain multiple doses of a treatment agent;
- at least one metering device adapted to draw up from the at least one compartment at least one treatment agent dose to be delivered to a laundry load to be treated during a laundry treatment cycle;
- a user interface comprising at least one input selector for allowing user selection of at least one treatment agent management function, the at least one treatment agent management function affecting the drawing up of the at least one treatment agent dose by the at least one metering device, and
- a communication interface for allowing a communication relationship between the laundry treatment appliance and an external user device.

The communication interface is preferably configured to receive from the external device enablement commands enabling the at least one input selector to allow said user selection of the at least one treatment agent management function.

According to an embodiment of the present invention, additional or alternative to any of the previous embodiments, the at least one input selector is, e.g. through the enablement commands received, enableable for allowing the user selection of the at least one treatment agent management function in addition to one or more predefined functions associated with said at least one input selector.

According to an embodiment of the present invention, additional or alternative to any of the previous embodiments, the at least one input selector is, e.g. through the enablement commands received, enableable for allowing the user selection of said at least one treatment agent management function in alternative to one or more predefined functions associated with said at least one input selector.

According to an embodiment of the present invention, additional or alternative to any of the previous embodiments, the at least one input selector is not associated with any predefined function.

According to an embodiment of the present invention, additional or alternative to any of the previous embodiments, the at least one input selector is, e.g. through the enablement commands received, enableable for allowing the user selection of said at least one treatment agent management function at least for a predetermined number of laundry treatment cycles or as long as the at least one compartment has not emptied.

According to an embodiment of the present invention, additional or alternative to any of the previous embodiments, the at least one input selector is, e.g. through the enablement commands received, enableable for allowing the user selection of the at least one treatment agent management function by means of a corresponding actuation mode of the at least one input selector.

Said actuation mode may for example comprise an actuation sequence or an actuation duration of the at least one input selector.

According to an embodiment of the present invention, additional or alternative to any of the previous embodiments, the at least one treatment agent management function comprises an adjusting function for allowing the user to adjust the at least one treatment agent dose with respect to at least one predefined treatment agent dose.

Said at least one predefined treatment agent dose may for example be affected by a manual input by the user.

According to an embodiment of the present invention, additional or alternative to any of the previous embodiments, said at least one predefined treatment agent dose is automatically determined by the laundry treatment appliance according to at least one among an estimate of the amount of laundry load, at least one property of the treatment agent, and the laundry treatment cycle.

According to an embodiment of the present invention, additional or alternative to any of the previous embodiments, the at least one treatment agent management function comprises a treatment agent type setting function allowing the user to set the type of treatment agent in the at least one compartment.

According to an embodiment of the present invention, additional or alternative to any of the previous embodiments, the at least one compartment comprises a first compartment and a second compartment. The at least one treatment agent management function advantageously comprises at least one between first and second treatment agent control functions.

Preferably, in the first treatment agent control function, the at least one treatment agent dose drawn up by the at least one metering device comprises, during the laundry treatment cycle, a first treatment agent dose drawn up from the first compartment and a second treatment agent dose drawn up from the second compartment.

Preferably, in the second treatment agent control function, during the laundry treatment cycle the at least one metering device is caused to draw up the at least one treatment agent dose from the first compartment or from the second compartment.

According to an embodiment of the present invention, additional or alternative to any of the previous embodiments, in the first treatment agent control function the first and second treatment agent doses are determined as respective amount of first and second types of laundry treatment agent, respectively, to be delivered to the laundry load during the laundry treatment cycle.

According to an embodiment of the present invention, additional or alternative to any of the previous embodiments, in the first treatment agent control function the first and second treatment agent doses are determined as respective partial amounts of a same type of treatment agent to be delivered to the laundry load during the laundry treatment cycle.

According to an embodiment of the present invention, additional or alternative to any of the previous embodiments, the first and second treatment agent doses are determined such as to provide substantially same level variations of the treatment agent in the first and second compartments during the laundry treatment cycle.

According to an embodiment of the present invention, additional or alternative to any of the previous embodiments, in the second treatment agent control function the at least one treatment agent dose is drawn up from the first compartment or from the second compartment according to one or more parameters of the laundry treatment cycle and/or one or more properties of the laundry load.

According to an embodiment of the present invention, additional or alternative to any of the previous embodiments, in the second treatment agent control function the at least one treatment agent dose drawn up from the first compartment or from the second compartment is determined, respectively, as an amount of a first type or of a second type of laundry treatment agent to be delivered to the laundry load during the laundry treatment cycle.

According to an embodiment of the present invention, additional or alternative to any of the previous embodiments, in the second treatment agent control function the at least one treatment agent dose is drawn up, during each laundry treatment cycle, from the first compartment or from the second compartment in such a way to determine a gradual concurrent emptying of the first and second compartments over a predetermined number of laundry treatment cycles.

According to an embodiment of the present invention, additional or alternative to any of the previous embodiments, the at least one treatment agent dose drawn up, during each laundry treatment cycle, from the first compartment or from the second compartment is determined as an amount of laundry treatment agent to be delivered to the laundry load during said laundry treatment cycle, and preferably comprises a same type of laundry treatment agent over said predetermined number of laundry treatment cycles.

According to an embodiment of the present invention, additional or alternative to any of the previous embodiments, upon enabling of the at least one input selector to allow the selection of said at least one treatment agent management function, said at least one function is discretionally selectable by the user through the at least one input selector or through the external device.

According to an embodiment of the present invention, additional or alternative to any of the previous embodiments, upon enabling of the at least one input selector to allow the selection of said at least one treatment agent management function, said at least one treatment agent management function is made non-selectable through the external device.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
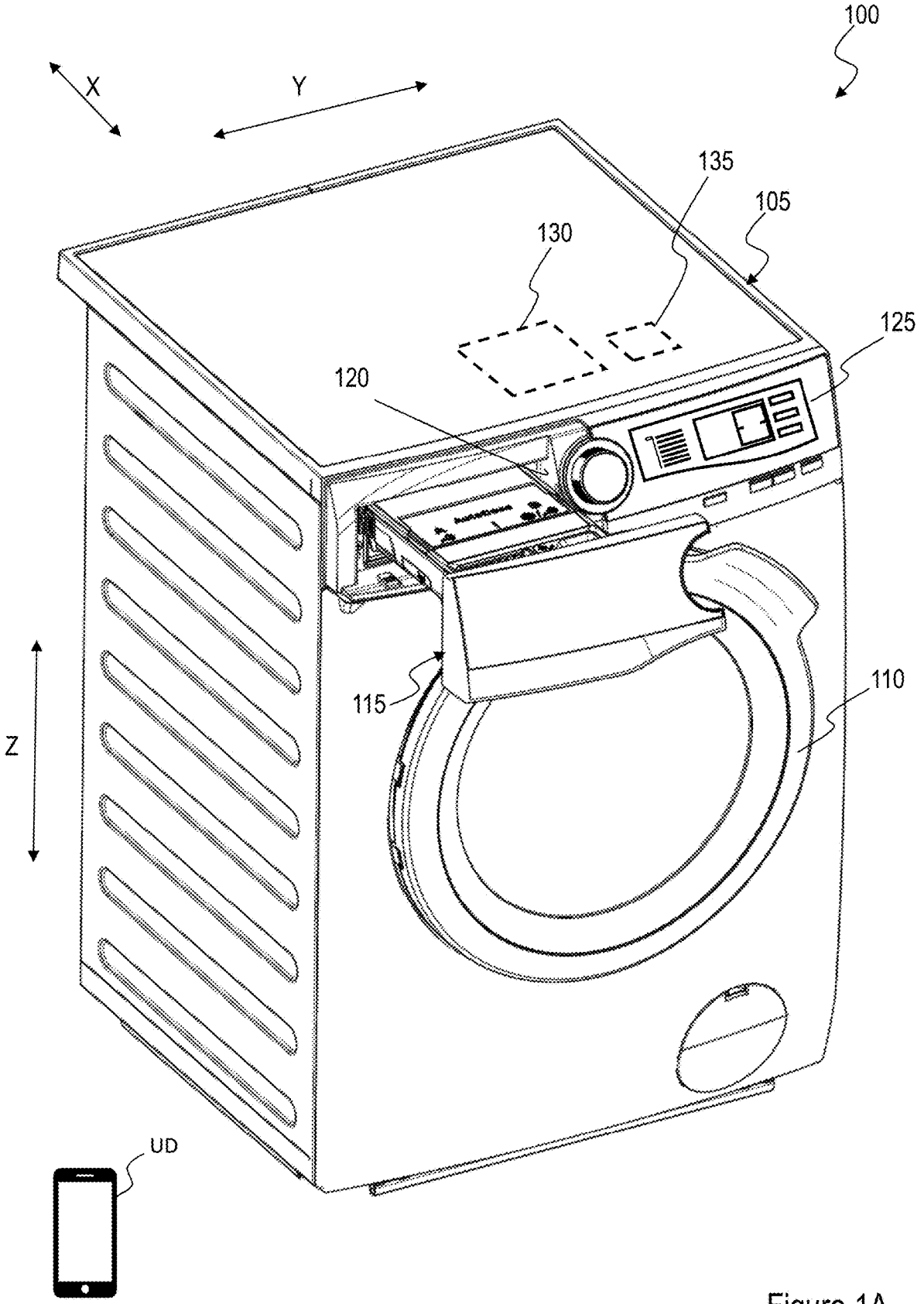
FIGS. 1A and 1B show perspective views of a laundry appliance according to an embodiment of the present invention.
Figure 1B:
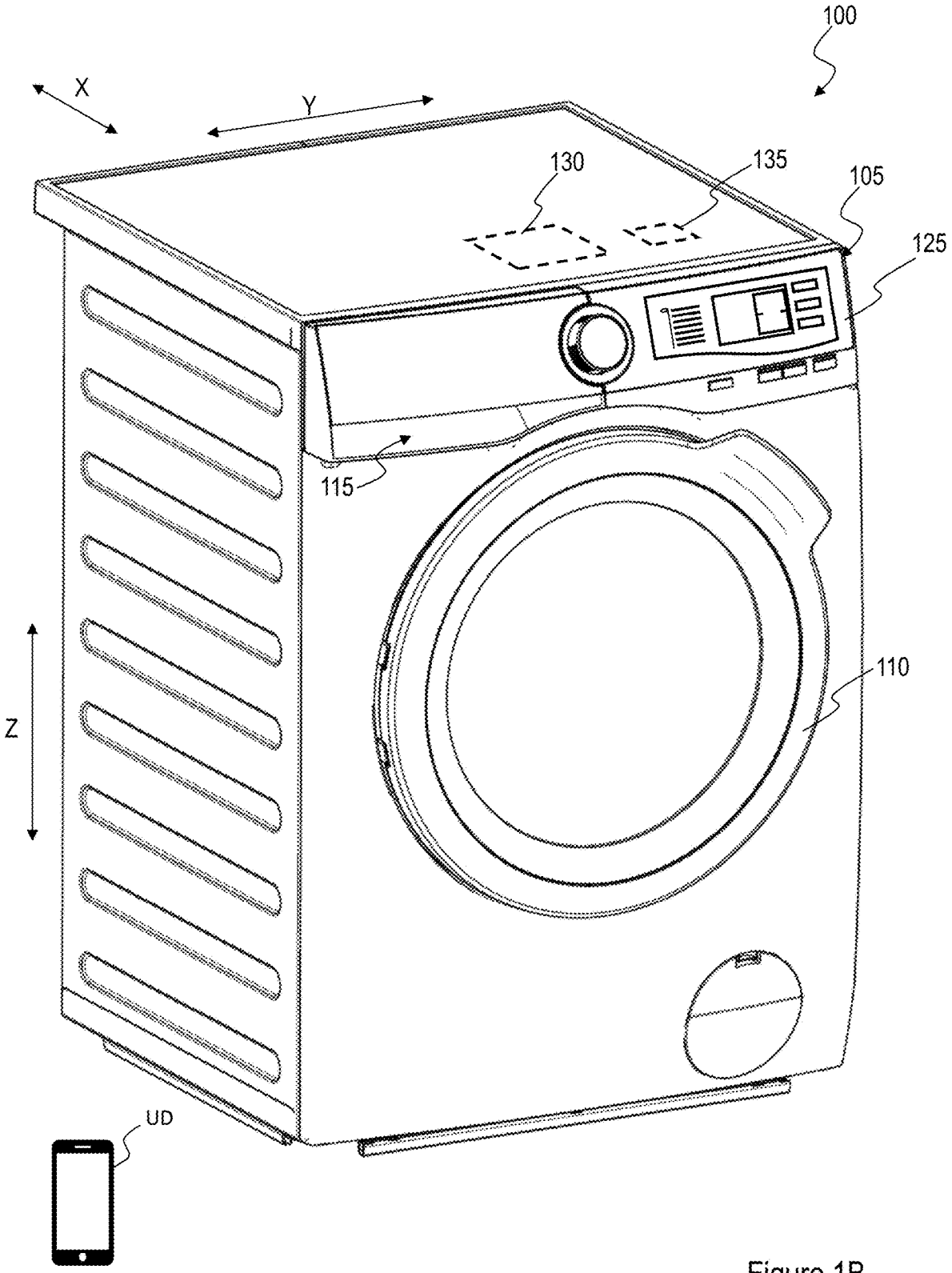

With reference to the drawings, FIGS. 1A and 1B show perspective views of a laundry treatment appliance (concisely, laundry appliance) 100 according to an embodiment of the present invention. According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions).

The laundry appliance 100 preferably comprises a (e.g., parallepiped-shaped) cabinet 105, which preferably accommodates a treatment chamber (i.e., a laundry washing chamber in the example herein considered of a washing machine) for performing a laundry treatment cycle on a laundry load housed therein (e.g., a washing cycle or program in the example herein considered of a washing machine).

The treatment chamber preferably comprises a washing tub (not shown) and, within it, a (e.g., rotatable) washing basket or drum (not shown) adapted to contain the laundry load to be treated. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

The laundry appliance 100 also comprises, enclosed in the cabinet 105, electrical/electronic/mechanical/hydraulic components for the operation of the laundry appliance 100 (such as for example motor, electromechanical valves, pump devices and impellers of the hydraulic apparatus, one or more heating elements for heating water/treatment agents/air), only the relevant ones for the understanding of the present invention being discussed in the following.

The laundry appliance 100 preferably comprises a drawer 115 for containing one or more laundry treatment agents (or, concisely, treatment agents), such as liquid and powder treatment agents including, but not limited to, washing detergents, rinsing detergents, bleaches and softeners.

The laundry appliance 100 preferably comprises a drawer seat 120 (preferably provided on a top part of a cabinet front) for housing the drawer 115, the drawer 115 being advantageously adapted to slide within the drawer seat 120, along a longitudinal or sliding direction X, between an extracted position (shown in FIG. 1A) and a retracted position (shown in FIG. 1B). The sliding direction X is for example parallel to a rest surface, such as the floor, on which the laundry appliance 100 preferably rests in operation (i.e., when it is installed in the user premises). In operation, the laundry appliance 100 rests on the rest surface, such as the floor, and uprightly extends from it along a vertical direction Z orthogonal to the sliding direction X.

Preferably, the laundry appliance 100 further comprises a user interface 125, the user interface 125 being preferably provided on the top part of the cabinet front, more preferably next to the drawer seat 120 along a transversal direction Y orthogonal to the longitudinal X and vertical Z directions.

An exemplary user interface 125 will be shown and described in the following when discussing treatment agent management functions of the laundry appliance according to embodiments of the present invention. For the purposes of the present disclosure, the user interface 125 comprises one or more input selectors for allowing user selection of one or more of the treatment agent management functions: as better discussed in the following, such treatment agent management function(s) is/are not selectable, by default (i.e., in the predefined input selector setup provided in the laundry appliance as marketed and bought by the user), through the user interface 125.

Preferably, the laundry appliance 100 is further provided with a control unit 130 for controlling the laundry appliance 100 (the control unit 130 being schematically illustrated as a dashed rectangle in FIGS. 1A and 1B) according to instructions received by a user through the user interface 125. The control unit 130 is generally configured to provide power and to interact with the electrical/electronic/mechanical/hydraulic components in order to manage the execution of selected treatment cycles.

For the purposes of the present disclosure, the control unit 130 is arranged to manage the treatment agent contained in the drawer 115 according to the selected treatment agent management function (as better discussed in the following).

As illustrated in FIGS. 1A and 1B, the laundry appliance 100 preferably comprises a communication interface or connection device 135 (for example a network interface controller or network adapter, schematically illustrated as a dashed rectangle in the figures) for allowing a (e.g., wired or wireless) a communication relationship (such as data exchange) between the laundry appliance 100 (e.g., the control unit 130 thereof) and an external user device being external to the laundry appliance 100.

According to the principles of the present invention, the communication interface 135 is configured to receive from the user device UD enablement commands enabling one or more input selector(s) to allow the user selection of one or more treatment agent management function(s); otherwise stated, the communication interface 135 is configured to receive from the user device UD enablement commands enabling an association between one or more input selectors and one or more treatment agent management functions. Advantageously, the enablement commands received at the communication interface 135 are fed (e.g., upon proper processing thereof) to the control unit 130, and the control unit 130 preferably performs an association, based on the enablement commands, between the corresponding input selector(s) and the treatment agent management function(s)—such an association being for example stored in a proper memory location, not shown, of the control unit 130.

The user device UD may for example be a personal digital assistant (PDA), a smartphone (as herein exemplary illustrated), a tablet, a wearable smart device (such as a smartwatch) or other mobile device having processing, input/output and memory units adapted to run software applications (i.e. mobile applications in the example at issue of a smartphone as user device UD).

For the purposes of the present disclosure, the mobile application run by (i.e., running on) the user device UD is adapted to present to the user the treatment agent management function(s), which is/are not selectable, by default, through the user interface 125. Advantageously, the mobile application running on the user device UD may be further adapted to present to the user one or more settings and/or options and/or modes (hereinafter, predefined functions) preferably selectable by default through user interface 125 (e.g., so as to allow selection thereof through the user device UD instead of the user interface 125).

Figure 2A:
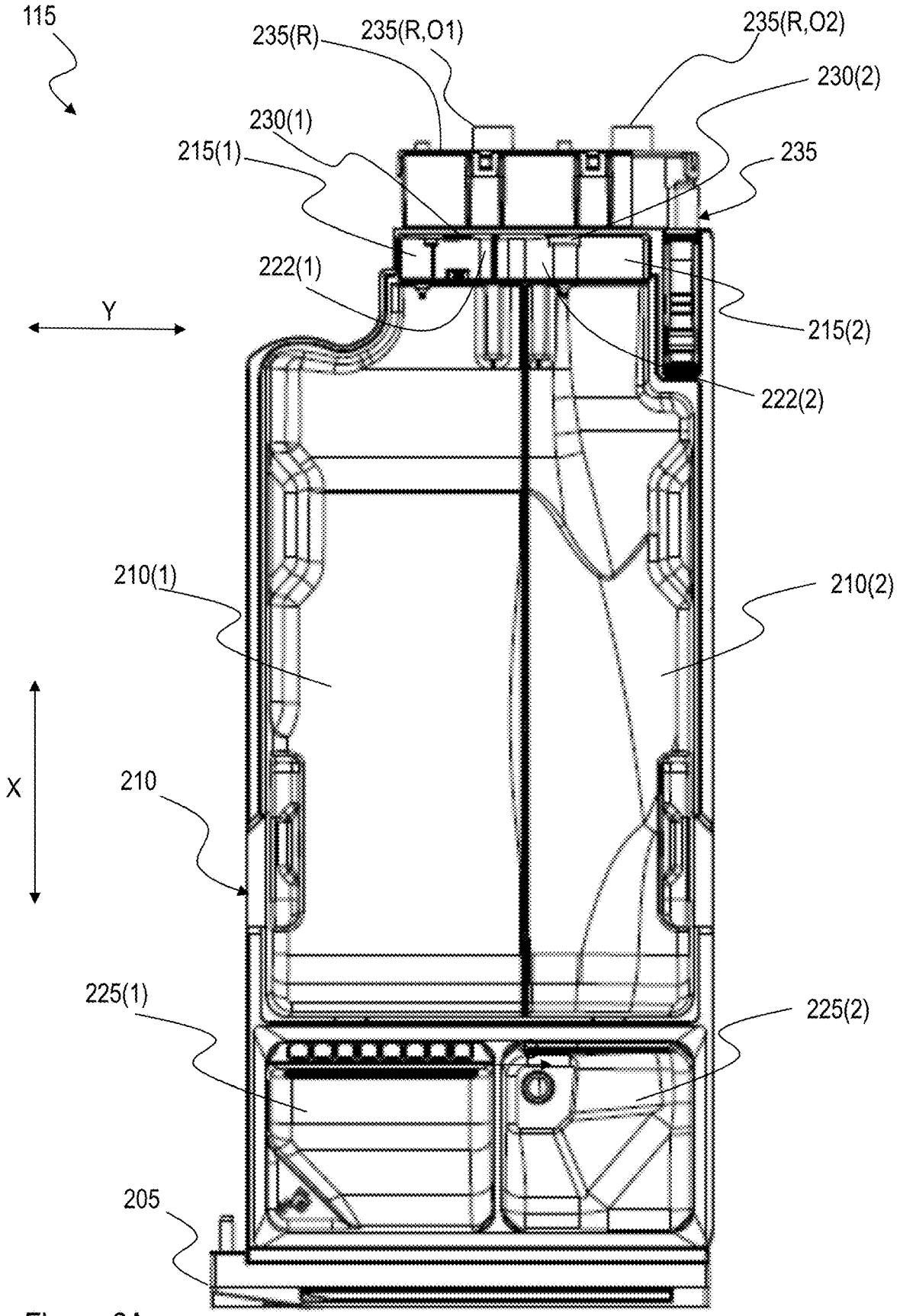
FIG. 2A shows a top view of a drawer of the laundry appliance according to an embodiment of the present invention.

With reference now also to FIG. 2A, it shows a top view of the drawer 115 according to an embodiment of the present invention. For ease of description, FIG. 2A will be discussed together with FIG. 2B, which shows a perspective view of the drawer 115 in a partially extracted position within the drawer seat 120.

The drawer 115 preferably comprises a drawer handle 205 allowing the user to slidably move the drawer 115 between the extracted position and the retracted position when it is fitted in the drawer seat 120, and a drawer body 210 to which the drawer handle 205 is adapted to be mounted or coupled or connected (advantageously, in a removable or reversible way). When the laundry appliance 100 is installed and the drawer 115 is fitted in the drawer seat 120, the drawer handle 205 identifies, along the sliding direction X, a drawer front (which advantageously forms part of the cabinet front when the drawer 115 is in the retracted position).

The drawer 115 (particularly, the drawer body 210) preferably comprises one or more (preferably, two or more) drawer compartments $\mathbf{210}_1$, $\mathbf{210}_2$ each one adapted to contain multiple doses of a treatment agent for multiple laundry treatments (e.g., multiple washing cycles), hereinafter referred to as multi-dose compartments $\mathbf{210}_1$, $\mathbf{210}_2$; therefore, the exemplary considered laundry appliance 100 is configured to implement an auto-dosing functionality in which, at each treatment cycle (and when the auto-dosing functionality is activated), an amount of treatment agent to be delivered to the laundry load to be treated during the treatment cycle (also referred to as treatment agent dose) is automatically taken by means of one or more metering devices (e.g., one or more pump devices, discussed in the following) from one or both of the multi-dose compartments $\mathbf{210}_1$, $\mathbf{210}_2$: as will be understood from the following discussion, the treatment agent management functions (that, through the enablement commands, are associated with the input selector(s)) affect the drawing up of the treatment agent dose(s) from the multi-dose compartments $\mathbf{210}_1$, $\mathbf{210}_2$ by the metering device(s).

Each multi-dose compartment $\mathbf{210}_1$, $\mathbf{210}_2$ is preferably configurable to contain multiple doses of a respective type of treatment agent. For the purposes of the present disclosure, by type of treatment agent it is herein meant a class of treatment agents having same tasks (in this respect, just as an example, pre-washing detergents, washing detergents and softeners identify respective types of treatment agents) or a class of treatment agents that, for the same tasks, also have similar chemical properties or compositions or active ingredients (in this respect, just as an example, liquid washing detergents having, for example, different concentration levels or different surfactants may identify respective types of treatment agents).

For example, each multi-dose compartment $\mathbf{210}_1$, $\mathbf{210}_2$ may be configurable to contain multiple doses of a treatment agent for washing treatment (e.g., a liquid washing detergent), a treatment agent for softening treatment (e.g., a liquid softener), or a treatment agent for carrying out additional treatments (e.g., a rinsing additive), although this should not be construed limitatively.

As can be appreciated in FIG. 2A, the multi-dose compartments $\mathbf{210}_1$, $\mathbf{210}_2$ preferably have reciprocally different (or slightly different) areas. When, as herein exemplary considered, same or substantially same extensions along the vertical direction Z for the multi-dose compartments $\mathbf{210}_1$, $\mathbf{210}_2$ are assumed, this difference in area translates into correspondingly different capacities of the multi-dose compartments $\mathbf{210}_1$, $\mathbf{210}_2$, although this should not be construed limitatively.

The drawer 115 (particularly, the drawer body 210) preferably comprises one or more channels associated with the multi-dose compartment(s) (e.g. two channels $\mathbf{215}_1$, $\mathbf{215}_2$ in the example at issue of two multi-dose compartments $\mathbf{210}_1$, $\mathbf{210}_2$); in the example herein considered, each channel $\mathbf{215}_1$, $\mathbf{215}_2$ is associated with a respective one of the multi-dose compartments $\mathbf{210}_1$, $\mathbf{210}_2$, the channel $\mathbf{215}_1$ being for example associated with the multi-dose compartment $\mathbf{210}_1$ and the channel $\mathbf{215}_2$ being for example associated with the multi-dose compartment $\mathbf{210}_2$). Each channel $\mathbf{215}_1$, $\mathbf{215}_2$ is preferably adapted to channel water and/or one or more treatment agent doses towards a region of the drawer seat 120 that allows a mixture between the water and the treatment agent dose(s) (hereinafter referred to as mixing region): the mixing region may for example be or comprise a bottom wall 220 of the drawer seat 120 (visible in FIG. 2B), the bottom wall 220 of the drawer seat 120 being advantageously slanted in order to promote a flow of the mixture between the water and the treatment agent dose(s) towards the treatment chamber of the laundry appliance 100.

As exemplary illustrated, the channels $\mathbf{215}_1$, $\mathbf{215}_2$ are preferably provided, along the sliding direction X, behind the multi-dose compartments $\mathbf{210}_1$, $\mathbf{210}_2$ (from the drawer front).

Advantageously, the channels $\mathbf{215}_1$, $\mathbf{215}_2$ (or at least one thereof) extend vertically with respect to the rest surface (such as the floor) on which the laundry appliance 100 rests in operation (the channels $\mathbf{215}_1$, $\mathbf{215}_2$ thus extending substantially along the vertical direction Z). In alternative embodiments of the present invention, the channels $\mathbf{215}_1$, $215_2$ (or at least one thereof) are inclined with respect to the rest surface (such as the floor) on which the laundry appliance 100 rests in operation. Regardless of the specific (vertical or inclined) orientation of the channels $215_1$, $215_2$, which is not limiting for the present invention, each channel $215_1$, $215_2$ is advantageously structured and shaped such as to allow the water and/or the treatment agent dose(s) to fall towards the mixing region of the drawer seat 120 by gravity; in order to achieve it, each channel $215_1$, $215_2$ advantageously comprises a top channel input for receiving the water from a water distribution system above it (not shown), and a bottom channel output facing the bottom wall 220 of the drawer seat 120; in operation, the bottom channel outputs of the channels $215_1$, $215_2$ are arranged for delivering the water and the treatment agent dose(s) to the bottom wall 220 of the drawer seat 120, and hence to the treatment chamber of the laundry appliance 100.

According to the preferred embodiment of the present invention herein considered and illustrated, the drawer 115 also comprises one or more (two, in the example at issue) drawer compartments $225_1$, $225_2$ each one adapted to contain a single dose of a respective treatment agent for performing a single treatment cycle, hereinafter referred to as mono-dose compartments $225_1$, $225_2$; just as an example, the mono-dose compartment $225_1$ may be arranged to contain a single dose of a powder or liquid washing detergent, whereas the mono-dose compartment $225_2$ may be arranged to contain a single dose of a powder or liquid or pearl softener.

Preferably, the mono-dose compartments $225_1$, $225_2$ are, along the sliding direction X, between the drawer handle 205 and the multi-dose compartments $210_1$, $210_2$. Forming the mono-dose compartments $225_1$, $225_2$ before the multi-dose compartments $210_1$, $210_2$ (along the sliding direction X, from the drawer handle 205) is advantageous in that a low or relatively low extraction of the drawer 115 is required for allowing the user to load the treatment agents in the mono-dose compartments $225_1$, $225_2$ (on the contrary, forming the mono-dose compartments $225_1$, $225_2$ behind the multi-dose compartments $210_1$, $210_2$ would dramatically impair the mechanical stability of the drawer 115, for example when extracting the drawer 115 to load the treatment agents in the mono-dose compartments $225_1$, $225_2$ and a certain amount of treatment agent is still stored in one or more of the multi-dose compartments $210_1$, $210_2$).

As visible in the figures, the mono-dose $225_1$, $225_2$ and multi-dose $210_1$, $210_2$ compartments have different capacities; particularly, the multi-dose compartments $210_1$, $210_2$ have larger capacities so as to store larger amounts of treatment agent as compared to the mono-dose compartments $225_1$, $225_2$. Although the mono-dose compartments $225_1$, $225_2$ are illustrated as having same or similar capacities, this should not be construed limitatively.

As mentioned above, the laundry appliance 100 also comprises one or more metering devices adapted to draw up the treatment agent dose(s) from the multi-dose compartment(s) under the control of the control unit 130. For the purposes of the present disclosure, the metering device(s) is/are adapted to draw up the treatment agent dose(s) from the multi-dose compartment(s) according to the treatment agent management function selected by the user (e.g., through the actuation of the corresponding input selector(s) enabled for this purpose, or through the user device UD, as better discussed in the following).

In the example at issue, two metering devices are provided; each metering device is preferably associated with a respective multi-dose compartment $210_1$, $210_2$ for drawing up respective treatment agent doses therefrom.

According to an embodiment of the invention, the metering devices comprise pump devices, preferably, peristaltic pump devices. However, similar considerations apply in case different pump devices are used, as well as different metering devices such as for example comprising valve devices and/or hydraulic systems comprising Venturi pipes.

Making reference to the embodiment of the invention illustrated in the figures, the pump devices may for example be variable-flow peristaltic pump devices (in which case the control unit 130 may be configured to cause the pump devices to draw up the treatment agent doses by controlling rotor speeds of the pump devices), or fixed-flow peristaltic pump devices (in which case the control unit 130 may be configured to cause the pump devices to draw up the treatment agent doses by controlling activation times of the pump devices e.g., through duty cycle variations of corresponding control or driving signals). However, in alternative embodiments of the present invention, both variable-flow and fixed-flow peristaltic pump devices may be provided (for example, a variable-flow peristaltic pump device associated with one of the multi-dose compartments $210_1$, $210_2$ and a fixed-flow peristaltic pump device associated with the other one of the multi-dose compartments $210_1$, $210_2$).

The pump devices are preferably provided, along the sliding direction X, behind the channels $215_1$, $215_2$ (from the drawer front).

More preferably, the pump devices are structured such that electrical parts thereof are physically separate from drawer portions (such as the multi-dose compartments $210_1$, $210_2$ and the channels $215_1$, $215_2$) experiencing treatment agent and/or water passage, and such that they are substantially unaffected by movement of the drawer 115 from the retracted position to the extracted position. In order to achieve it, each pump device preferably comprises a pump actuation part (advantageously provided in the drawer body 210) and an electrically-operated pump driving part (advantageously provided in the drawer seat 120) adapted to couple to each other when the drawer 115 is in the retracted position, upon said coupling the electrically-operated pump driving parts allowing driving of the pump actuation parts.

Each pump actuation part preferably comprises a respective suction side in fluid communication with the multi-dose compartment $210_1$, $210_2$ for drawing up the treatment agent dose(s) therefrom, and a respective delivery side in fluid communication with the channel $215_1$, $215_2$ for delivering the treatment agent dose(s) thereto.

Preferably, the drawer 115 comprises a suction pipe $222_1$, $222_2$ (visible in FIG. 2A) coupling the suction side of the pump actuation part to an interior of the multi-dose compartment $210_1$, $210_2$ for drawing up the treatment agent dose therefrom, and a delivery pipe $230_1$, $230_2$ coupling the delivery side of the pump actuation part to an interior of the channel $215_1$, $215_2$ for delivering the treatment agent dose thereto. The suction pipe $222_1$, $222_2$ is preferably arranged, in the interior of the respective multi-dose compartment $210_1$, $210_2$, proximate to a bottom wall of the multi-dose compartment $210_1$, $210_2$, so as to allow drawing up of treatment agent doses even when the multi-dose compartment $210_1$, $210_2$ is almost empty. The delivery pipe $230_1$, $230_2$ preferably opens to the interior of the respective channel $215_1$, $215_2$, preferably between (for example, in the middle or substantially in the middle of) the top channel input and the bottom channel output thereof (only end parts of the delivery pipes $230_1$, $230_2$ that open to the interior of the respective channels $215_1$, $215_2$ being visible in FIG. 2A).

Each pump actuation part comprises a respective pumping member (not shown) adapted to push a quantity of the washing agent contained in a respective multi-dose compartment 210$_1$, 210$_2$ through the respective suction 222$_1$, 222$_2$ and delivery 230$_1$, 230$_2$ pipes and, therefore, towards the mixing region of the drawer seat 120. Preferably, the suction 222$_1$, 222$_2$ and delivery 230$_1$, 230$_2$ pipes are in the form of deformable tubes, each pumping member preferably comprising a peristaltic rotor (not shown) being adapted to hydraulically cooperate with the respective deformable tubes. More preferably, each peristaltic rotor comprises one or more projecting portions (e.g. in the form of rollers, not visible) adapted to be arranged in contact with the walls of the respective deformable tube and capable of locally compressing it, thus generating a consequent narrowing that allows the fluid (i.e., the treatment agent dose(s)) to move during the rotation of the peristaltic rotor.

Each electrically-operated pump driving part may for example comprise an electric motor (not shown) selectively actuatable (e.g., by means of the electronic control unit 130) for operating the respective pumping member, and an output shaft (not shown) adapted to be fitted into a corresponding seat of the respective pumping member, so as to couple or engage with each other when the drawer 115 is moved to the retracted position.

Figure 2B:
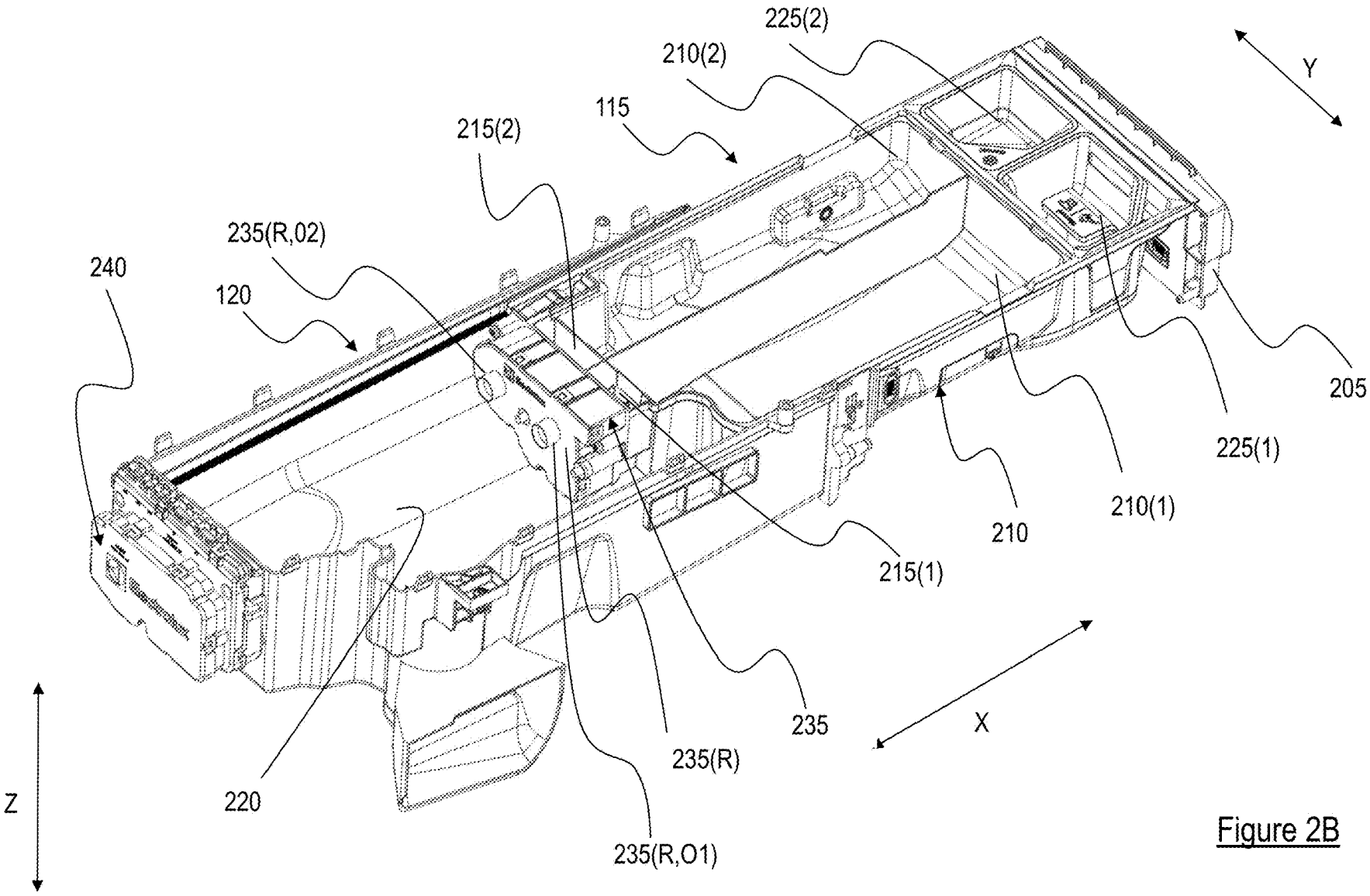
FIG. 2B shows a perspective view of the drawer of FIG. 2A in a partially extracted position within a drawer seat, according to an embodiment of the present invention.

The pumping members are advantageously enclosed, on a rear side of the drawer 115 (rear with respect to the drawer front along the sliding direction X), by a rotor shell 235 (visible in FIGS. 2A and 2B). More preferably, a rear wall 235$_R$ of the rotor shell 235 comprises openings (two openings 235$_{R,O1}$, 235$_{R,O2}$ in the example at issue), through which the output shafts of the electric motors are able to pass for being coupled with the pumping members (particularly, with the seats thereof). Even more preferably, as illustrated, the openings 235$_{R,O1}$, 235$_{R,O2}$ are delimited by walls (e.g., tubular walls) projecting along the sliding direction X from the rear wall 235$_R$ of the rotor shell 235; these projecting walls advantageously have centering, aligning and guiding functions for the output shafts to be passed into the openings 235$_{R,O1}$, 235$_{R,O2}$.

The electric motors are advantageously enclosed in a motor shell 240 (visible in FIG. 2B), preferably fixed on the drawer seat 120 (and, hence, separate from drawer body 210) and facing the rear wall 235$_R$ of the rotor shell 235 along the sliding direction X. The motor shell 240 is preferably provided with openings, not shown, through which the output shafts of the electric motors project: in this way, when the drawer 115 is moved to the retracted position (i.e., towards the motor shell 240), the output shafts of the electric motors engage the pumping members, thus allowing mechanical and electrical connection therebetween.

Although not shown, the drawer 115 may comprise a drawer body cover for covering the drawer body 210. The drawer body cover may be configured to cover the drawer body 210 in correspondence of the multi-dose compartments 210$_1$, 210$_2$, thus leaving uncovered both the channels 215$_1$, 215$_2$, and particularly the top channel inputs thereof (which can therefore be accessed by water fed by a water distribution system, not shown, preferably provided at a top of the drawer seat 120). The drawer body cover may comprise one or more access openings, not shown, each one for accessing a respective multi-dose compartment 210$_1$, 210$_2$ for loading the treatment agent therein; one or more access components (such as one or more doors, for example one or more flap doors pivotally coupled to the drawer body cover) may advantageously be provided for selectively covering and uncovering the access openings thereby respectively preventing and allowing access to the respective multi-dose compartments 210$_1$, 210$_2$.

With reference also to FIGS. 3A-3D, they show portions of the user interface 125 according to embodiments of the present invention.

Preferably, although not necessarily, the user interface 125 comprises a display unit 305 for visually displaying one or more pieces of information; the display unit 305 may for example comprise a light emitting polymer display (LPD), a liquid crystal display, a thin film transistor-liquid crystal display, or an organic light-emitting diode display. In the preferred, not limiting, embodiment herein considered, the display unit 305 comprises a touch sensitive display unit to allow user selection of laundry appliance setting and/or options and/or functionalities by touching activated regions of the display unit 305.

As exemplary illustrated, the display unit 305 comprises a cycle section, i.e. a section where a number of selectable treatment cycles are listed. The treatment cycles may be presented or listed with a graphic layout comprising textual indications (and/or symbols) associated with the selectable treatment cycles. The textual indications (and/or associated symbols) are preferably vertically superimposed one to the other in order to form a column of textual indications (and/or associated symbols). In the example illustrated, the treatment cycles are presented as a number of textual indications generically named "cycle 1", "cycle 2", "cycle 3", "cycle 4", "cycle 5", "cycle 6", "cycle 7", "cycle 8", "cycle 9", and may for example be conventional treatment cycles including, but not limited to, "Cottons", "Cotton ECO" "Synthetics", "Delicates", "Wool/Handwash". The treatment cycles may for example be selected through a rotary knob (such as the rotary knob visible in FIGS. 1A and 1B), whose rotation advantageously causes a cursor or other pointer or slider to move vertically across the list of treatment cycle to visually indicate to the user the currently selected treatment cycle (however, embodiments of the present invention may be envisaged in which no rotary knob is provided and the cursor is a touch sensitive cursor moveable by user touch to select the treatment cycle).

As exemplary illustrated, the display unit 305 advantageously comprises a display region 310 for displaying status information such as information about a status of one or more components of the laundry appliances 100 and/or information about a status of the treatment cycle (including, but not limited to, information about a residual time to the end of the ongoing treatment cycle, and/or information about a current phase of the ongoing treatment cycle, and/or selected parameters for the ongoing treatment cycle).

As mentioned above, the user interface 125 comprises one or more input selectors enableable for allowing user selection of one or more treatment agent management functions not selectable, by default, through the user interface 125.

Without losing generality, the input selectors may for example comprise physical input selectors, i.e. input selectors whose activation/deactivation is associated with displacements of mechanical components (such as the rotary knob visible in FIGS. 1A and 1B, or mechanical keys), and/or one or more virtual input selectors, i.e. input selectors whose activation/deactivation is associated with touch-sensitive electric components. In the preferred embodiment herein considered in which the display unit 305 comprises a touch sensitive display unit, the input selectors are advantageously virtual input selectors.

According to an embodiment of the present invention, the input selectors, or at least a subset thereof, are enableable (through the enablement commands) for allowing the user selection of the treatment agent management function(s) in addition to one or more predefined functions associated with the input selectors. Additionally or alternatively, the input selectors, or at least a subset thereof, are enableable (through the enablement commands received) for allowing the user selection of the treatment agent management function(s) in alternative to the predefined function(s) associated with the input selectors.

In the exemplary illustrated embodiment, three input selectors 315$_1$, 315$_2$, 315$_3$ are provided, each one being for example associated with one or more predefined function(s) such as treatment cycle temperature, laundry load dirt level, spin speed, start time delay, and drawer compartment selection.

Each input selector 315$_1$, 315$_2$, 315$_3$, or at least a subset thereof, is advantageously enableable (through the enablement commands) for allowing the user selection of one or more of the treatment agent management functions. The enablement of the input selector(s) 315$_1$, 315$_2$, 315$_3$ to allow the user selection of the treatment agent management function(s) (or, otherwise stated, the association between the input selector(s) 315$_1$, 315$_2$, 315$_3$ and the treatment agent management function(s)) preferably lasts for a predetermined number of treatment cycles or as long as at least one of the multi-dose compartments 210$_1$, 210$_2$ has not emptied (in that, as will be better understood in the following when discussing exemplary treatment agent management functions, some of the treatment agent management functions are more suited to be implemented with two multi-dose compartments 210$_1$, 210$_2$ actually usable); preferably, after the predetermined number of treatment cycles or upon emptying of one of the multi-dose compartments 210$_1$, 210$_2$, the control unit 130 may be configured to disable the input selector(s) 315$_1$, 315$_2$, 315$_3$ previously enabled to allow the user selection of the treatment agent management function(s), thus restoring back the input selector(s) 315$_1$, 315$_2$, 315$_3$ association with the only predefined function(s) thereof (if any).

Advantageously, each input selector 315$_1$, 315$_2$, 315$_3$, or at least a subset thereof, is, through the enablement commands, enableable for allowing the user selection of the treatment agent management function(s) by means of a corresponding actuation mode of the at least one input selector, the actuation mode including for example actuation sequence or an actuation duration of the enabled input selector(s) 315$_1$, 315$_2$, 315$_3$ to access/select the treatment agent management function(s). According to an embodiment of the present invention, the actuation mode of the input selector(s) for allowing the selection of the treatment agent management function(s) is selected by the user through the user device UD, and may be preferably included in the enablement commands or provided to the communication interface 135 (and, hence, to the control unit 130) through separate or dedicated signalling.

Preferably, as illustrated, the display unit 305 comprises a display region (or more thereof) 320 for displaying a graphical indication of a (e.g., activated or deactivated) status the auto-dosing functionality. More preferably, the display region (or more thereof) 320 is arranged for displaying a graphical indication of the selected treatment agent management function. Even more preferably, the display region 320 comprises a (e.g., upper) display region 320$_1$ associated with the multi-dose compartment 210$_1$ and a (e.g., lower) display region 320$_2$ associated with the multi-dose compartment 210$_2$. Exemplary graphical indications displayed in the display regions 320$_1$, 320$_2$ will be mentioned in the following when discussing some of the treatment agent management functions.

According to embodiments of the present invention, the treatment agent management functions comprise one or more among an adjusting function for allowing the user to adjust the treatment agent dose, a treatment agent type setting function for allowing the user to set the type of treatment agent in one or all of the multi-dose compartments 210$_1$, 210$_2$, and treatment agent control functions aimed at controlling the drawing up of the treatment agent dose(s) to be delivered to the laundry load.

Just as an example, the adjusting function may preferably allow the user to increase and/or decrease the treatment agent dose, for example with respect to a predefined treatment agent dose (or more thereof).

In order to achieve that, according to a basic implementation, one of the input selectors 315$_1$, 315$_2$, 315$_3$ may be enabled (through the user device UD) to allow an increase of the treatment dose, and another one of the input selectors 315$_1$, 315$_2$, 315$_3$ may be enabled (through the user device UD) to allow a decrease of the treatment dose. In any case, alternative implementations may be envisaged: just as an example, one of the input selectors 315$_1$, 315$_2$, 315$_3$ may be enabled (through the user device UD) to allow an increase or a decrease of the treatment agent dose according to a respective actuation mode (e.g., a respective actuation sequence or a respective actuation duration) of that enabled input selector. Similarly, when two of the input selectors 315$_1$, 315$_2$, 315$_3$ are enabled to allow the increase and the decrease of the treatment agent dose in addition to one or more predefined functions associated with such input selectors, the increase or decrease of the treatment agent dose may advantageously be selected (and, hence, the adjusting function may be accessed) through prolonged actuation duration of the respective input selector.

The predefined treatment agent dose may for example comprise a default or minimum treatment agent dose preferably affected by a manual input by the user (and advantageously stored in a proper memory location of the control unit 130).

Just as an example, the predefined treatment agent dose may be determined by the control unit 130 according to at least one property of the treatment agent (such as chemical properties or compositions or active ingredients) manually input by a user (e.g., through the user interface 125, or through the user device UD)—in any case, the possibility that the property/properties of the treatment agent is/are, at least partially, automatically recognized by the laundry appliance 100 (e.g., through one or more dedicated sensors thereof, not shown) is not excluded.

Additionally or alternatively, the predefined treatment agent dose may be automatically determined by the laundry appliance 100 (e.g., the control unit 130 thereof) according to an estimate of the amount of laundry load, and the treatment cycle being selected.

As mentioned above, the treatment agent management functions may comprise a treatment agent type setting function for allowing the user to set the type of treatment agent in one or all of the multi-dose compartments 210$_1$, 210$_2$.

Just as an example, the multi-dose compartment 210$_1$ may be set to contain multiple doses of a first type of treatment agent (e.g., a washing detergent), and the multi-dose compartment 210$_2$ may be set to contain multiple doses of the (same) first type of treatment agent, or of a second type of treatment agent (e.g., a softener or a pre-washing detergent or a rinsing additive, or also a different washing detergent, such as a washing detergent having a different concentration level).

In order to achieve that, according to a basic implementation, one of the input selectors 315$_1$, 315$_2$, 315$_3$ may be enabled (through the user device UD) to allow an association thereof with one of the multi-dose compartments 210$_1$, 210$_2$, and another one of the input selectors 315$_1$, 315$_2$, 315$_3$ may be enabled (through the user device UD) to allow an association thereof with the other one of the multi-dose compartments 210$_1$, 210$_2$, with the enabling of the input selectors that advantageously also enables the possibility of selecting the type of treatment agent of the respective multi-dose compartments 210$_1$, 210$_2$: just as an example, the actuation of one of the enabled input selectors by the user may allow the selection of the respective multi-dose compartment 210$_1$, 210$_2$, and one or more following actuations of the same input selector may advantageously allow cycling between selectable types of treatment agent for that multi-dose compartment 210$_1$, 210$_2$.

As mentioned above, the treatment agent management functions may comprise treatment agent control functions aimed at controlling the drawing up of the treatment agent dose(s) to be delivered to the laundry load (through the channels 215$_1$, 215$_2$ and the bottom wall 220 of the drawer seat 120). In the following, four treatment agent control functions CF1, CF2, CF3, CF4 will be discussed by way of example only.

According to an advantageous embodiment of the present invention, each input selector 315$_1$, 315$_2$, 315$_3$, or at least a subset of the input selectors 315$_1$, 315$_2$, 315$_3$, is, through the enablement commands received, enableable for allowing the user selection of the treatment agent control function(s) CF1, CF2, CF3, CF4, or at least a subset thereof.

According to an embodiment of the present invention, each input selector 315$_1$, 315$_2$, 315$_3$ may be associated with (i.e. enabled to allow user selection of) a respective treatment agent control function CF1, CF2, CF3, CF4, or more thereof: just as an example, when one of the input selectors 315$_1$, 315$_2$, 315$_3$ is associated with more than one treatment agent control functions CF1, CF2, CF3, CF4, the desired treatment agent control function CF1, CF2, CF3, CF4 may advantageously be selected according to a respective actuation mode of that input selector (such as through a respective actuation duration of that input selector).

Similarly, when one or more of the input selectors 315$_1$, 315$_2$, 315$_3$ are enabled to allow the selection of one or more of the treatment agent control functions CF1, CF2, CF3, CF4 in addition to one or more predefined functions associated with such input selectors, the treatment agent control function(s) CF1, CF2, CF3, CF4 may advantageously be selected through prolonged actuation duration of the respective input selector(s).

Additionally or alternatively, each treatment agent control function CF1, CF2, CF3, CF4 may be accessed through a predefined or user-defined actuation sequence of one or more of the input selectors 315$_1$, 315$_2$, 315$_3$ (the actuation sequence being for example definable by the user through the user device UD, particularly through the application running on it). Just as an example, the treatment agent control functions CF1, CF2, CF3, CF4 may be selected through single, double, triple and quadruple touches, respectively, of a same input selector.

It has to be appreciated that several other implementations could be contemplated, which provide an interaction with the two or more input selectors using different touching/pressing sequences and/or timings.

With reference also to FIGS. 4A, 4B, 4C and 4D, they show examples of first CF1, second CF2, third CF3 and fourth CF4 treatment agent control functions, respectively, according to an embodiment of the present invention.

In these figures, the metering device (i.e., the pump device) associated with the multi-dose compartment 210$_1$ is schematically depicted with reference $P_1$, and the metering device (i.e., the pump device) associated with the multi-dose compartment 210$_2$ is schematically depicted with reference $P_2$.

Figure 4A:
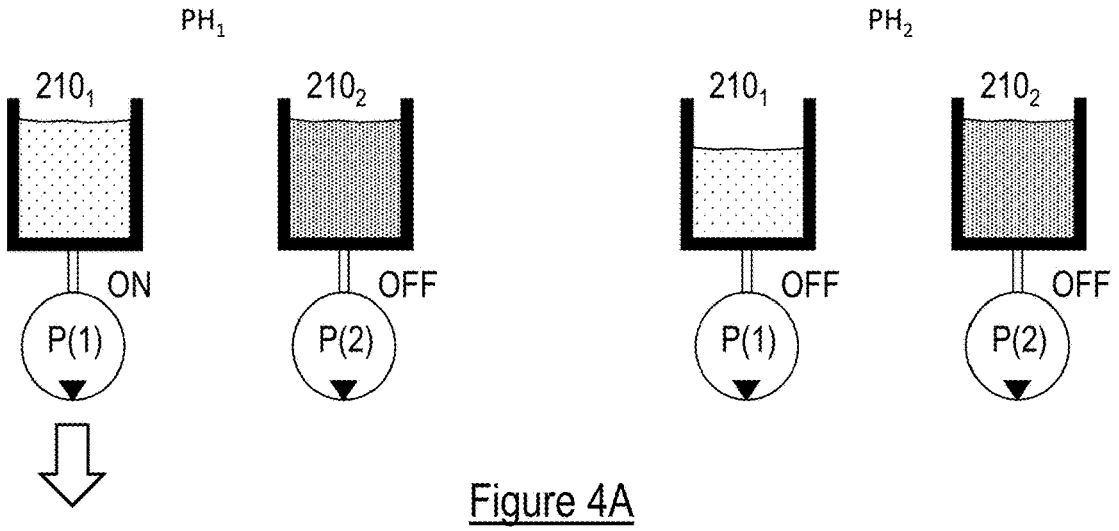
FIGS. 4A, 4B, 4C and 4D show examples of treatment agent control functions according to embodiments of the present invention.
Figure 4B:
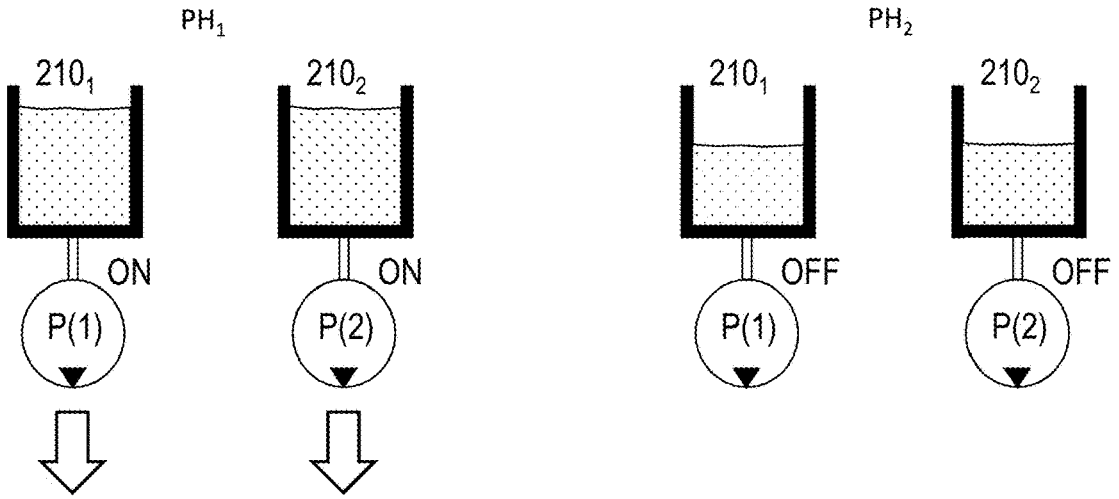
Figure 4C:
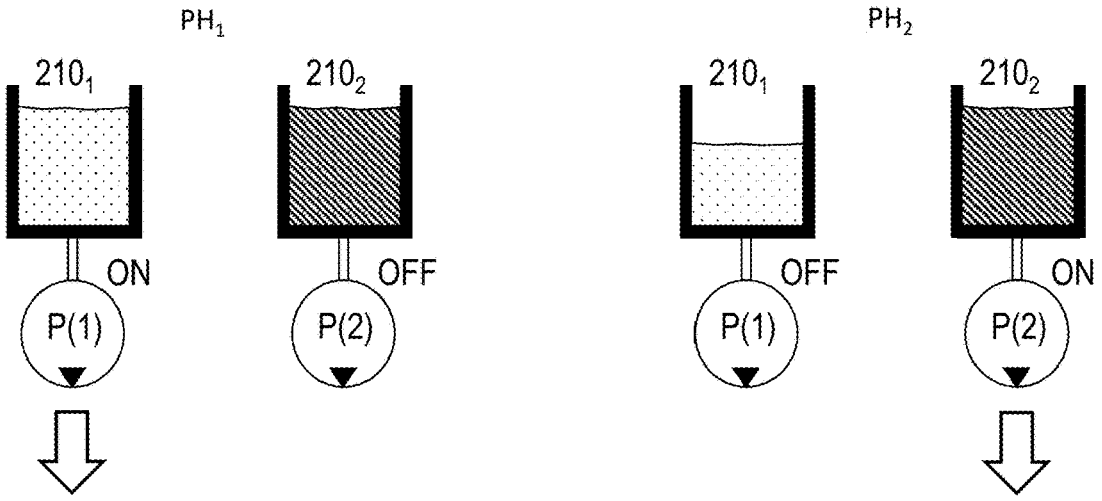
Figure 4D:
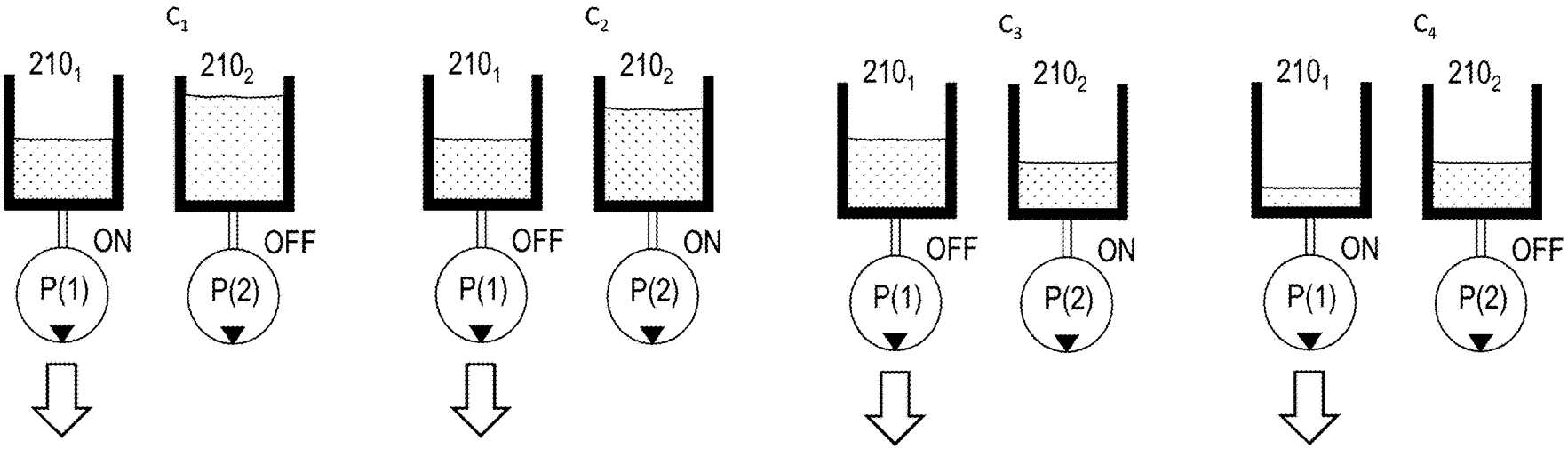

Moreover, in FIGS. 4A, 4B and 4C, a first phase of a treatment cycle carried out by the laundry appliance 100 is identified with reference $PH_1$ and a subsequent second phase of the same treatment cycle is identified with reference $PH_2$, and different, consecutive four cycles carried out by the laundry appliance are identified by $C_1$, $C_2$, $C_3$ and $C_4$ in FIG. 4D (e.g., with the treatment cycle $C_2$ that follows the treatment cycle $C_1$, with the treatment cycle $C_3$ that follows the treatment cycle $C_2$, and with the treatment cycle $C_4$ that follows the treatment cycle $C_3$). The first $PH_3$ and second $PH_2$ phases may for example be a main washing phase and a rinsing phase, respectively; however, the principles of the present invention equivalently apply to one or more phases associated with different types of laundry treatment, such as for example a prewashing phase.

When the first treatment agent control function CF1 is selected, the control unit 130 advantageously causes a selected pump device between the pump devices $P_1$, $P_2$ to draw up a treatment agent dose from the respective multi-dose compartment 210$_1$, 210$_2$ during a selected phase between the first phase $PH_1$ and the second phase $PH_2$, and keeps off the other pump device during both the first $PH_3$ and second $PH_2$ phases.

Making reference to the exemplary treatment agent control function CF1 illustrated in FIG. 4A:

- during the first phase $PH_3$, the control unit 130 causes the activation of the pump device $P_1$ to draw up from the multi-dose compartment 210$_1$ a dose of the treatment agent contained therein, while keeping turned off the pump device $P_2$;
- during the second phase $PH_2$, the control unit 130 keeps turned off both the pump devices $P_1$ and $P_2$.

The first treatment agent control function CF1 is particularly suited to be selected when the treatment agent contained in the multi-dose compartment 210$_1$ and the treatment agent contained in the multi-dose compartment 210$_2$ are of different types but carry out the same task, and therefore are not suited to be used together during a same treatment cycle.

Therefore, when the first treatment agent control function CF1 is selected, and the multi-dose compartment 210$_1$, 210$_2$ contains different types of treatment agents carrying out the same task, only one of these two treatment agents is drawn up by the respective pump device $P_1$, $P_2$ for being delivered to the treatment chamber of the laundry appliance 100 during the treatment cycle.

For example, in the first treatment agent control function CF1, the multi-dose compartment 210$_1$ may contain a washing detergent having a first concentration level, and the multi-dose compartment 210$_2$ may contain a washing detergent having a second concentration level different than the first concentration level. In this case, by selecting either the multi-dose compartment 210$_1$ or the multi-dose compartment 210$_2$ it is possible to carry out a treatment cycle using a different concentration level washing detergent.

Naturally, other implementations of the first treatment agent control function CF1 are possible, such as:

during the first phase $PH_1$ only the pump device $P_2$ is activated, and during the second phase $PH_2$ the pump devices $P_1$, $P_2$ are both turned off;

during the first phase $PH_1$ the pump devices $P_1$, $P_2$ are both turned off, and during the second phase $PH_2$ only the pump device $P_1$ is activated;

during the first phase $PH_1$ the pump devices $P_1$, $P_2$ are both turned off, and during the second phase $PH_2$ only the pump device $P_2$ is activated.

According to an advantageous implementation of the first treatment agent control function CF1, each multi-dose compartment $\mathbf{210}_1$, $\mathbf{210}_2$ may be associated with a respective group of treatment cycles, whereby the control unit 130 may be configured to (automatically) select one of the multi-dose compartments $\mathbf{210}_1$ and $\mathbf{210}_2$ according to one or more parameters of the treatment cycle and/or one or more properties of the laundry load.

Just as an example, the multi-dose compartment $\mathbf{210}_1$ may be associated with treatment cycles directed to washing operations for delicate laundry—this means that the multi-dose compartment $\mathbf{210}_1$ is configured to contain washing detergent of a type suitable to be employed with delicate laundry—and the multi-dose compartment $\mathbf{210}_2$ may be associated with treatment cycles directed to washing operations for normal, non-delicate, laundry—this means that the multi-dose compartment $\mathbf{210}_2$ is configured to contain washing detergent of a type suitable to be employed with normal, non-delicate laundry. In this case, the control unit 130 may be configured to cause the pump device $P_1$ to draw up a treatment agent dose from the multi-dose compartment $\mathbf{210}_1$ if the selected treatment cycle is directed to perform washing operations for delicate laundry, or to cause the pump device $P_2$ to draw up a treatment agent dose from the multi-dose compartment $\mathbf{210}_2$ if the selected treatment cycle is directed to perform washing operations for normal, non-delicate, laundry.

The association between the multi-dose compartments $\mathbf{210}_1$, $\mathbf{210}_2$ and treatment cycles may be set according to factory settings, or by the user (for example through the user interface 125 and/or through the user device UD). Additionally or alternatively, if the laundry appliance 100 is capable of automatically detecting the type of treatment agent contained in each multi-dose compartment $\mathbf{210}_1$, $\mathbf{210}_2$ (for example, by means of suitable treatment agent sensor(s)), such an association may be automatically and dynamically carried out by the control unit 130 based on the detected type of treatment agent.

According to an exemplary but not limitative embodiment of the invention illustrated in FIG. 4A, when the first treatment agent control function CF1 is selected, the upper display region $\mathbf{320}_1$ (e.g., associated with the multi-dose compartment $\mathbf{210}_1$) displays a washing detergent symbol provided with a "1" digit on side, whereas the lower display region $\mathbf{320}_2$ (e.g., associated with the multi-dose compartment $\mathbf{210}_2$) displays a washing detergent symbol provided with a "2" digit on side. In this way, the user is provided with a clear and immediate indication about the laundry appliance 100 that is configured to have the multi-dose compartment $\mathbf{210}_1$ loaded with a first type of washing detergent and the multi-dose compartment $\mathbf{210}_2$ with a second type of washing detergent, and to carry out the next treatment cycle with a selected one between such two different types of washing detergents.

When the second treatment agent control function CF2 is selected, the control unit 130 advantageously causes both the pump devices $P_1$, $P_2$ to draw up treatment agent dose(s) from the respective multi-dose compartments $\mathbf{210}_1$, $\mathbf{210}_2$ during at least one between the first $PH_1$ and second $PH_2$ phases.

Making reference to the exemplary second treatment agent control function CF2 illustrated in FIG. 4B:

during the first phase $PH_1$, the control unit 130 causes the activation of both the pump devices $P_1$, $P_2$ to draw up from the respective multi-dose compartments $\mathbf{210}_1$, $\mathbf{210}_2$ a dose of the treatment agent contained therein;

during the second phase $PH_2$, the control unit 130 keeps turned off both the pump devices $P_1$, $P_2$.

The second treatment agent control function CF2 is particularly suited to be selected when the treatment agent contained in the multi-dose compartment $\mathbf{210}_1$ and the treatment agent contained in the multi-dose compartment $\mathbf{210}_2$ are of the same type (the multi-dose compartments $\mathbf{210}_1$, $\mathbf{210}_2$ for example containing a washing detergent), and therefore are suited to be used together during a same treatment cycle. In this case, the two multi-dose compartments $\mathbf{210}_1$, $\mathbf{210}_2$ are exploited in such a way to increase the overall capacity of the drawer 115 with respect to a single treatment agent.

Therefore, when the second treatment agent control function CF2 is selected, and the multi-dose compartments $\mathbf{210}_1$, $\mathbf{210}_2$ contain the same type of treatment agent, the operations carried out by the laundry appliance 100 during a treatment cycle exploit doses of the same treatment agent drawn up from both the two multi-dose compartments $\mathbf{210}_1$, $\mathbf{210}_2$.

In other words, when the second treatment agent control function CF2 is selected, a first treatment agent dose is drawn up from the multi-dose compartment $\mathbf{210}_1$ and a second treatment agent dose is drawn up from the multi-dose compartment $\mathbf{210}_1$ during a same phase of the treatment cycle (or even during different phases, but still in the same treatment cycle), with the first and second treatment agent doses that are preferably determined by the control unit 130 as respective partial amounts of a same type of treatment agent to be delivered to the laundry load during the treatment cycle (otherwise stated, in the second treatment agent control function CF2 the first and second treatment agent doses are respective portions or apportioning of an overall amount of treatment agent to be used during the ongoing treatment cycle).

According to an advantageous implementation of the second treatment agent control function CF2, the first and second treatment agent doses are determined such as to provide substantially same level variations of the treatment agent in the multi-dose compartments $\mathbf{210}_1$, $\mathbf{210}_2$ during the laundry treatment cycle (as schematically illustrated in FIG. 4B, second phase $PH_2$): this allows obtaining a gradual concurrent emptying of the multi-dose compartments $\mathbf{210}_1$, $\mathbf{210}_2$, and avoids that one of the two multi-dose compartments $\mathbf{210}_1$, $\mathbf{210}_2$ is emptied much before the other one and left unused for relatively long periods of time (thus preventing the formation of encrustations which may reduce the performances of the laundry appliance 100).

In order to achieve it, the first and second treatment agent doses (or, equivalently, the first and second portions of the overall amount of treatment agent to be used during the single treatment cycle) may be equal or different to each other. When, for example, the multi-dose compartments $\mathbf{210}_1$, $\mathbf{210}_2$ have different capacities, the first and second treatment agent doses are preferably different to each other, the first treatment agent dose being advantageously proportional to a portion or percentage of the overall capacity that is associated with the multi-dose compartment $\mathbf{210}_1$ and the second treatment agent dose being advantageously proportional to a portion or percentage of the overall capacity portion that is associated with the multi-dose compartment $\mathbf{210}_2$.

Naturally, other implementations of the second treatment agent control function CF2 are possible, such as:

during the first phase $PH_1$ the pump devices $P_1$, $P_2$ are both turned off, and during the second phase $PH_2$ the pump devices $P_1$, $P_2$ are both activated;

during both the first phase $PH_1$ and the second phase $PH_2$ the pump devices $P_1$, $P_2$ are both activated.

Irrespective of the specific implementation, in the second treatment agent control function CF2 the pump devices $P_1$, $P_2$ are preferably operated depending on the capacities of the multi-dose compartments $\mathbf{210}_1$, $\mathbf{210}_2$ and on their drawing capability, especially when same (or substantially same) level variations of the treatment agent in the multi-dose compartments $\mathbf{210}_1$, $\mathbf{210}_2$ are desired during a single treatment cycle.

When, for example, the multi-dose compartments $\mathbf{210}_1$, $\mathbf{210}_2$ have same (or substantially same) capacities (and same (or substantially same) level variations of the treatment agent in the multi-dose compartments $\mathbf{210}_1$, $\mathbf{210}_2$ are desired), the pump devices $P_1$, $P_2$ are advantageously activated and deactivated at the same time (i.e., same activation times) and at same rotor speeds—alternatively, the pump devices $P_1$, $P_2$ could be activated for different activation times depending on the respective rotor speeds.

When, instead, the multi-dose compartments $\mathbf{210}_1$, $\mathbf{210}_2$ have different capacities (and same (or substantially same) level variations of the treatment agent in the multi-dose compartments $\mathbf{210}_1$, $\mathbf{210}_2$ are desired), the pump devices $P_1$, $P_2$ are advantageously activated, for the same rotor speeds, for activation times proportional to the capacities of the respective multi-dose compartments (e.g., with one of the two pump devices that is turned on or off before the other one), or, for the same activation time, with rotor speeds proportional to the capacities of the respective multi-dose compartments (e.g., with one of the two pump devices that has a slower rotor speed than the other one).

According to an exemplary but not limitative embodiment of the invention illustrated in FIG. 4B, when the second treatment agent control function CF2 is selected, both the upper display region $\mathbf{320}_1$ and the lower display region $\mathbf{320}_2$ display a washing detergent symbol, and at the same time a "chain link" is advantageously displayed. In this way the user is provided with a clear and immediate indication about the laundry appliance 100 that is configured to have the multi-dose compartments $\mathbf{210}_1$, $\mathbf{210}_2$ loaded with the same type of washing detergent, and to carry out the next treatment cycle by drawing up treatment agents from both the multi-dose compartments $\mathbf{210}_1$, $\mathbf{210}_2$ in such a way to preferably cause substantially same level variations thereof during the treatment cycle.

When the third treatment agent control function CF3 is selected, the control unit 130 advantageously causes a selected pump device between the pump devices $P_1$, $P_2$ to draw up a treatment agent dose from the respective multi-dose compartment $\mathbf{210}_1$, $\mathbf{210}_2$ during a selected phase between the first phase $PH_1$ and the second phase $PH_2$, and causes the other pump device different from the selected pump device to draw up a treatment agent dose from the respective multi-dose compartment $\mathbf{210}_1$, $\mathbf{210}_2$ during the other phase different from the selected phase.

Making reference to the exemplary third treatment agent control function CF3 illustrated in FIG. 4C:

during the first phase $PH_1$, the control unit 130 causes the activation of the pump device $P_1$ to draw up from the multi-dose compartment $\mathbf{210}_1$ a dose of the treatment agent contained therein, while keeping turned off the other pump device $P_2$;

during the second phase $PH_2$, the control unit 130 causes the activation of the pump device $P_2$ to draw up from the multi-dose compartment $\mathbf{210}_2$ a dose of the treatment agent contained therein, while keeping turned off the other pump device $P_1$.

The third treatment agent control function CF3 is particularly suited to be selected when the treatment agent contained in the multi-dose compartment $\mathbf{210}_1$ and the treatment agent contained in the multi-dose compartment $\mathbf{210}_2$ are of different types and carry out different tasks, and therefore are suited to be used during different phases of a same treatment cycle.

Therefore, when the third treatment agent control function CF3 is selected, and the multi-dose compartments $\mathbf{210}_1$, $\mathbf{210}_2$ contains different types of treatment agents carrying out different tasks, each one of said types of treatment agent is drawn up from the respective pump device $P_1$, $P_2$ for being delivered to the treatment chamber of the laundry appliance 100 during a respective phase of the treatment cycle to carry out a respective task.

In other words, when the third treatment agent control function CF3 is selected, a first treatment agent dose is drawn up from the multi-dose compartment $\mathbf{210}_1$ during a phase of the treatment cycle (for example, the first phase $PH_1$) and a second treatment agent dose is drawn up from the multi-dose compartment $\mathbf{210}_1$ during a different phase of the treatment cycle (for example, the second phase $PH_2$), with the first and second treatment agent doses that are therefore determined as respective amounts of the first and second types of laundry treatment agent, respectively, to be delivered to the laundry load during the laundry treatment cycle.

For example, in the third treatment agent control function CF3, the multi-dose compartment $\mathbf{210}_1$ may contain a washing detergent, and the multi-dose compartment $\mathbf{210}_2$ may contain a softener. In this case, the first phase $PH_1$ may be a washing phase in which a dose of the washing detergent contained in the multi-dose compartment $\mathbf{210}_1$ is employed for performing washing operations on the laundry load, and the second phase $PH_2$ may be a rinsing phase in which a dose of the softener contained in the multi-dose compartment $\mathbf{210}_2$ is employed for conditioning the laundry load.

Naturally, other implementations of the third treatment agent control function CF3 are possible, such as when, during the first phase $PH_1$, the pump device $P_1$ is kept off and the pump device $P_2$ is activated, while, during the second phase $PH_2$, the pump device $P_1$ is activated and the pump device $P_2$ is kept off.

Figure 3A:
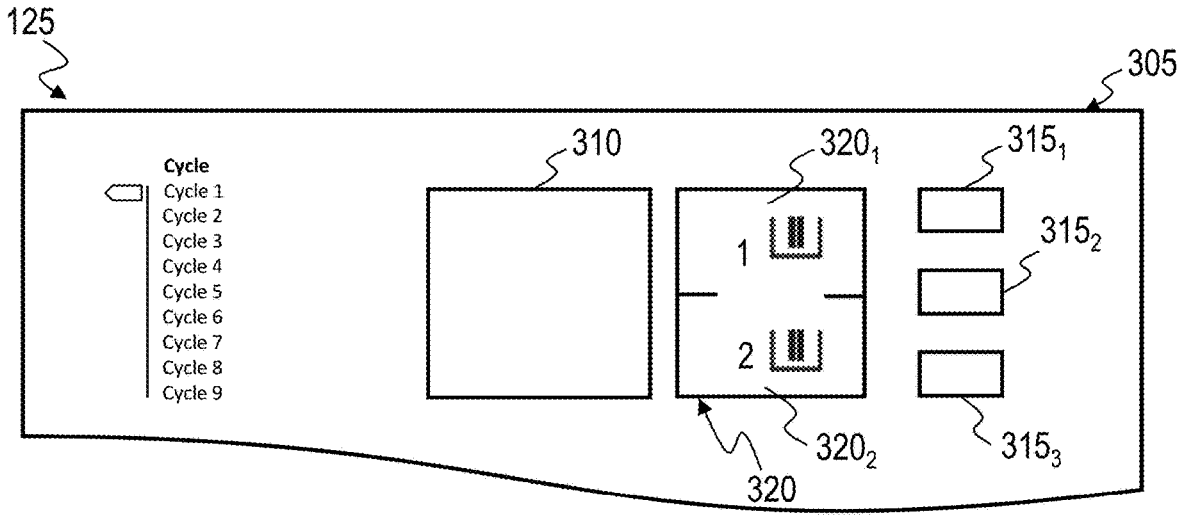
FIGS. 3A, 3B, 3C and 3D show portions of a user interface of the laundry appliance according to embodiments of the present invention.
Figure 3B:
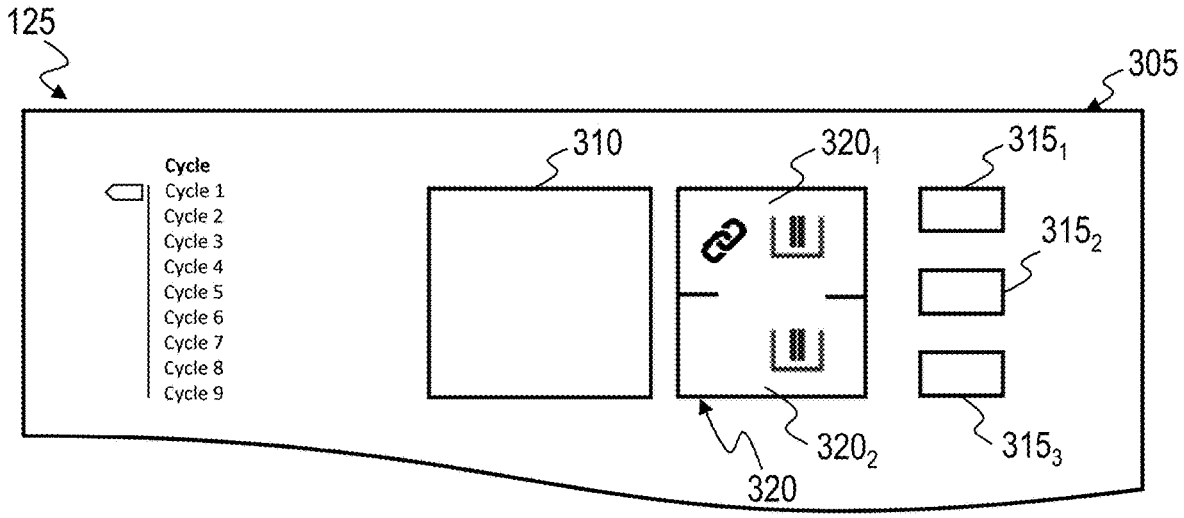
Figure 3C:
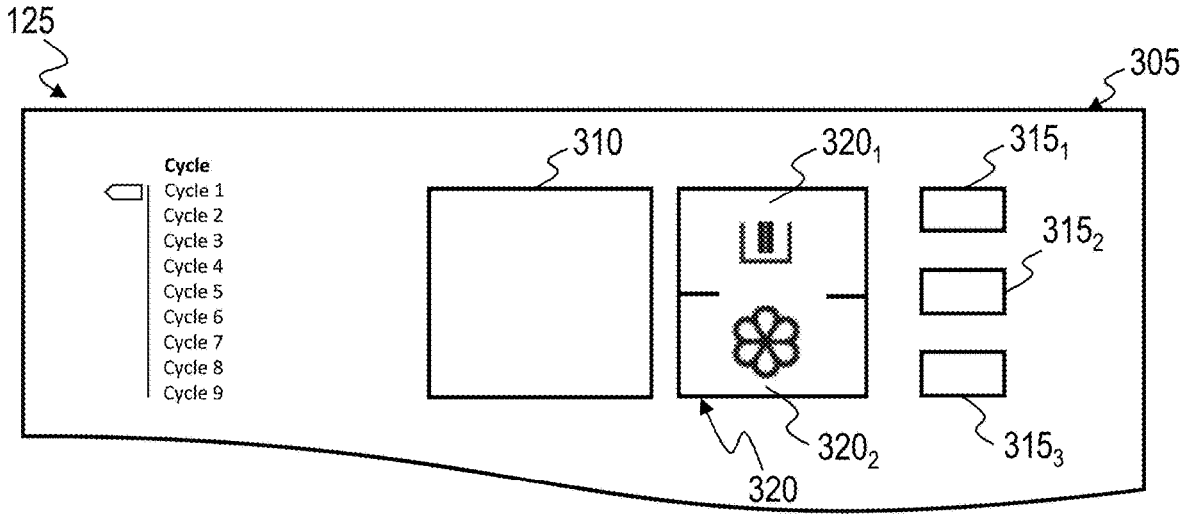
Figure 3D:
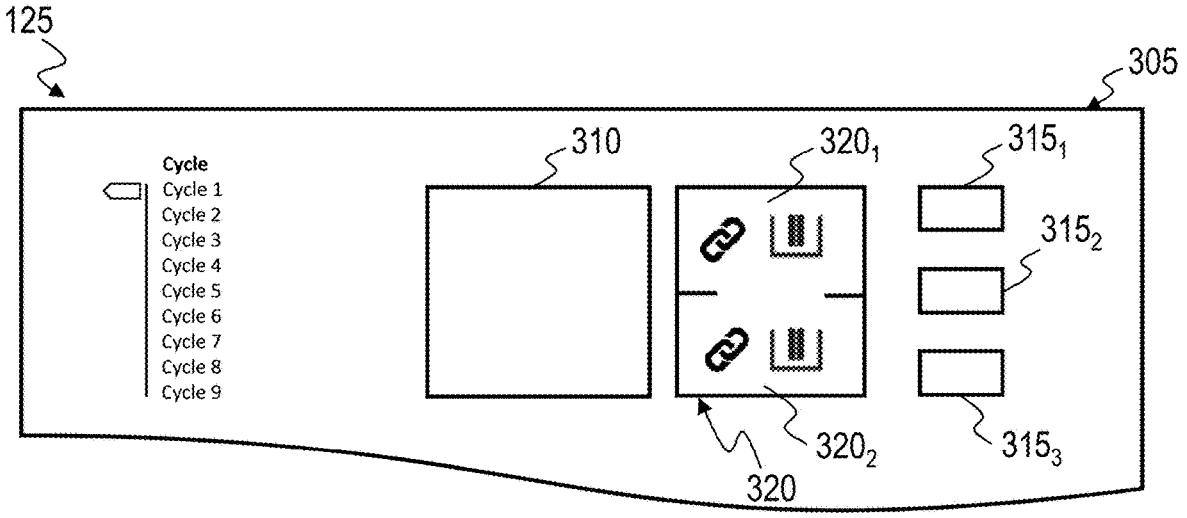

According to an exemplary but not limitative embodiment of the invention illustrated in FIG. 3C, when the third treatment agent control function CF3 is selected, the upper display region $\mathbf{320}_1$ associated with the multi-dose compartment $\mathbf{210}_1$ displays a washing detergent symbol, and the lower display region $\mathbf{320}_2$ displays a softener symbol. In this way the user is provided with a clear and immediate indication about the laundry appliance 100 that is configured to have the multi-dose compartment $\mathbf{210}_1$ loaded with washing detergent and the multi-dose compartment $\mathbf{210}_2$ loaded with softener, and to carry out the next treatment cycle using the washing detergent during a phase of the treatment cycle and the softener during another phase of the treatment cycle.

When the fourth treatment agent control function CF4 is selected, the control unit 130 advantageously causes, during each treatment cycle, the drawing up of the treatment agent dose from the multi-dose compartment 210$_1$ or from the multi-dose compartment 210$_2$ in such a way to determine a gradual concurrent emptying of the multi-dose compartments 210$_1$, 210$_1$ over a predetermined number of (two or more) treatment cycles. Therefore, in the fourth treatment agent control function CF4 the control unit 130 is configured to control the pump devices $P_1$, $P_2$ such as to cause them to coordinately draw up the treatment agent doses over two or more treatment cycles by determining a gradual concurrent emptying of the multi-dose compartments 210$_1$, 210$_2$ over said treatment cycles.

The fourth treatment agent control function CF4 is particularly suited to be selected when the treatment agent contained in the multi-dose compartment 210$_1$ and the treatment agent contained in the multi-dose compartment 210$_2$ are of the same type (the multi-dose compartments 210$_1$, 210$_2$ for example containing a washing detergent), intended to be used over a number of treatment cycles. In this case, the two multi-dose compartments 210$_1$, 210$_2$ are exploited in such a way to increase the overall capacity of the drawer 115 with respect to a single treatment agent, and the treatment agent dose drawn up, during each treatment cycle, from the multi-dose compartment 210$_1$ or from the multi-dose compartment 210$_2$ is determined as the amount of treatment agent to be delivered to the laundry load during that treatment cycle.

Preferably, by gradual concurrent emptying it is meant, in the context of the fourth treatment agent control function CF4, that the treatment agent doses drawn up from the multi-dose compartments 210$_1$, 210$_2$ determine substantially same level variations of the treatment agents contained in the multi-dose compartments 210$_1$, 210$_2$ over the two or more treatment cycles.

According to an embodiment, same level variations in the multi-dose compartments 210$_1$, 210$_2$ over the two or more treatment cycles may be obtained according to historical amounts of treatment agents drawn up in previous treatment cycles in the multi-dose compartments 210$_1$, 210$_2$. Preferably, during a current treatment cycle, the control unit 130 may be configured to draw up the necessary treatment agent dose from the multi-dose compartment 210$_1$ if, during a number of previous washing cycles before the current washing cycle, the total amount of treatment agent drawn up from the multi-dose compartment 210$_1$ is lower than the total amount of treatment agent drawn up from the multi-dose compartment 210$_2$, or to draw up the necessary treatment agent dose from the multi-dose compartment 210$_2$ otherwise.

The number of previous treatment cycles may for example be a predefined number of previous treatment cycles before the current treatment cycle. Additionally or alternatively, the number of previous treatment cycles may comprise the previous treatment cycles from an initial washing cycle, the initial treatment cycle being for example the first treatment cycle after both multi-dose compartments 210$_1$, 210$_2$ have emptied and subsequently refilled by the user, and/or an arbitrary treatment cycle selectable by the user (e.g., through the user interface 125 and/or through the mobile application running on the user device UD).

Making reference to the exemplary fourth treatment agent control function CF4 illustrated in FIG. 4D, considering for example four treatment agent doses $D_A$-$D_D$ to be drawn up during the respective four treatment cycles $C_1$-$C_4$ (with each treatment agent dose $D_A$, $D_B$, $D_C$, $D_D$ that thus represents the overall amount of treatment agent to be used during the single treatment cycle $C_1$, $C_2$, $C_3$, $C_4$, respectively), assuming that the treatment cycle $C_1$ is the initial treatment cycle, and assuming $D_A$=50 ml, $D_B$=25 ml, $D_C$=30 ml, $D_D$=40 ml (the different treatment agent doses depending, for example, on the selected washing cycle and/or on a level of dirt of the laundry load and/or on chemical properties of the treatment agents and/or on a weight of the laundry load and/or on a fine adjusting of the treatment agent doses performed by the user), the coordinate drawing up of the treatment agent doses over the four treatment cycles $C_1$-$C_4$ may for example take place as follows:

- treatment cycle $C_1$: treatment agent dose $D_A$ drawn up from multi-dose compartment 210$_1$ (which is herein assumed to be set as default multi-dose compartment). Therefore, in the treatment cycle $C_1$ the pump device $P_1$ is on and the pump device $P_2$ is off, the multi-dose compartment 210$_1$ thus experiencing a level variation of $D_A$=50 ml;
- treatment cycle $C_2$: treatment agent dose $D_B$ drawn up from multi-dose compartment 210$_2$ (in that the level variation experienced so far by the multi-dose compartment 210$_2$, i.e. 0 ml, is lower than the level variation experienced so far by the multi-dose compartment 210$_1$, i.e. 50 ml). Therefore, in the treatment cycle $C_2$ the pump device $P_2$ is on and the pump device $P_1$ is off, the multi-dose compartment 210$_2$ thus experiencing a level variation of $D_B$=25 ml;
- treatment cycle $C_3$: treatment agent dose $D_C$ drawn up from multi-dose compartment 210$_2$ (in that the level variation experienced so far by the multi-dose compartment 210$_2$, i.e. 20 ml, is lower than the level variation experienced so far by the multi-dose compartment 210$_1$, i.e. 50 ml). Therefore, in the treatment cycle $C_3$ the pump device $P_2$ is on and the pump device $P_1$ is off, the multi-dose compartment 210$_2$ thus experiencing an overall level variation of $D_B$+$D_C$=55 ml from the initial treatment cycle $C_1$;
- treatment cycle $C_4$: treatment agent dose $D_D$ drawn up from multi-dose compartment 210$_2$ (in that the level variation experienced so far by the multi-dose compartment 210$_2$, i.e. 50 ml, is lower than the level variation experienced so far by the multi-dose compartment 210$_1$, i.e. 55 ml). Therefore, in the treatment cycle $C_4$ the pump device $P_1$ is on and the pump device $P_2$ is off, the multi-dose compartment 210$_1$ thus experiencing an overall level variation of $D_A$+$D_D$=90 ml from the initial treatment cycle $C_1$.

According to an exemplary but not limitative embodiment of the invention illustrated in FIG. 4D, when the fourth treatment agent control function CF4 is selected, both the upper display region 320$_1$ and the lower display region 320$_2$ display a washing detergent symbol, and at the same time a "chain link" is advantageously displayed both in the upper display region 320$_1$ and in the lower display region 320$_2$. In this way the user is provided with a clear and immediate indication about the laundry appliance 100 that is configured to have the multi-dose compartments 210$_1$, 210$_2$ loaded with the same type of washing detergent, and to carry out two or more next treatment cycles by drawing up washing detergents from the multi-dose compartment 210$_1$ or from the multi-dose compartment 210$_2$ (in such a way to preferably cause a gradual concurrent emptying thereof over such next treatment cycles.

Summarizing, the treatment agent control functions broadly comprise two kinds of treatment agent control functions, namely a first kind of treatment agent control function (including the second CF2 and third CF3 treatment agent control functions) in which a first treatment agent dose is drawn up from the multi-dose compartment $\mathbf{210}_1$ and a second treatment agent dose is drawn up from the multi-dose compartment $\mathbf{210}_2$ during a single treatment cycle, and a second kind of treatment agent control function (including the first CF1 and fourth CF4 treatment agent control functions) in which, during a single treatment cycle, the pump devices are caused to draw up the treatment agent dose to be delivered to the laundry load from the multi-dose compartment $\mathbf{210}_1$ or from the multi-dose compartment $\mathbf{210}_2$.

An advantageous embodiment of the present invention provides that, upon enabling of the input selector(s) to allow the selection of the desired treatment agent management function(s), the treatment agent management function(s) is/are discretionally selectable by the user through the enabled input selector(s) or through the user device UD (e.g., so as to allow the user to select the desired treatment agent management function(s) both locally through the user interface 125 and remotely through the user device UD).

According to an advantageous alternative of the present invention, upon enabling of the input selector(s) to allow the selection of the desired treatment agent management function(s), the treatment agent management function(s) is/are made non-selectable through the user device UD (e.g., so as to allow the user to easily distinguish in the application running on the user device UD between the treatment agent management functions already associated with the input selector(s) and the treatment agent management functions not yet associated with any input selector(s)).

Although in the foregoing explicit reference has been exemplary made to input selectors $\mathbf{310}_1$, $\mathbf{310}_2$, $\mathbf{310}_3$ associated (e.g. by default) with predefined functions, same considerations apply when the input selectors $\mathbf{310}_1$, $\mathbf{310}_2$, $\mathbf{310}_3$, or at least a part thereof, are not associated with any predefined function. Moreover, although in the foregoing explicit reference has been made to input selectors enableable to allow the user selection of the above-described treatment agent management functions (namely, the treatment agent type setting function, the adjusting function, and the treatment agent control functions CF1-CF4), it should be apparent that the input selectors may be enableable to allow the user selection of any other function (such as the above-mentioned treatment cycle temperature, laundry load dirt level, spin speed, start time delay, and drawer compartment selection), thus obtaining an even higher degree of configurability of the user interface 125.

Moreover, the possibility of obtaining a complete configurability of the user interface 125 is not excluded. In order to achieve it, all the input selectors provided in the user interface 125 may be associated with no predefined function(s), so that the user may define through the user device UD (particularly, through the application running on it) the function(s) to be associated with each input selector (i.e., both basic functions, including for example the above mentioned predefined functions, and advanced functions, including for example the above discussed treatment agent management functions).

Moreover, in case of completely touch sensitive user interface, the configurability allowed by the present invention may also permit to the user to arrange virtual selectors (each one enabled by the user to allow selection of one or more basic and/or advanced functions) in any desired position, and preferably to associate symbols or icons thereto, thus defining a completely customized user interface.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry treatment appliance comprising:

at least one compartment configured to contain multiple doses of a treatment agent;

at least one metering device configured to draw up from the at least one compartment at least one treatment agent dose to be delivered to a laundry load to be treated during a laundry treatment cycle;

a user interface comprising at least one input selector configured to, when the at least one input selector is enabled by a user, allow user selection of at least one treatment agent management function, the at least one treatment agent management function affecting the drawing up of the at least one treatment agent dose by the at least one metering device, and a communication interface configured to allow a communication relationship between the laundry treatment appliance and an external user device, the communication interface being configured to receive from the external device enablement commands enabling the at least one input selector to allow the user selection of the at least one treatment agent management function, wherein, without enabling of the at least one input selector to allow the selection of said at least one treatment agent management function, the at least one treatment agent management function is made non-selectable through the external device.

2. The laundry treatment appliance according to claim 1, wherein the at least one input selector is, through the enablement commands received, enableable for allowing the user selection of the at least one treatment agent management function in addition to one or more predefined functions associated with said at least one input selector.

3. The laundry treatment appliance according to claim 1, wherein the at least one input selector is, through the enablement commands received, enableable for allowing the user selection of said at least one treatment agent management function in alternative to one or more predefined functions associated with said at least one input selector.

4. The laundry treatment appliance according to claim 1, wherein the at least one input selector is not associated with any predefined function.

5. The laundry treatment appliance according to claim 1, wherein the at least one input selector is, through the enablement commands received, enableable for allowing the user selection of the at least one treatment agent management function by means of a corresponding actuation mode of the at least one input selector.

6. The laundry treatment appliance according to claim 1, wherein the at least one treatment agent management function comprises an adjusting function for allowing the user to adjust the at least one treatment agent dose with respect to at least one predefined treatment agent dose.

7. The laundry treatment appliance according to claim 6, wherein said at least one predefined treatment agent dose is affected by a manual input by the user.

8. The laundry treatment appliance according to claim 6, wherein said at least one predefined treatment agent dose is automatically determined by the laundry treatment appliance according to at least one among an estimate of the amount of laundry load, at least one property of the treatment agent, and the laundry treatment cycle.

9. The laundry treatment appliance according to claim 1, wherein the at least one treatment agent management function comprises a treatment agent type setting function allowing the user to set the type of treatment agent in the at least one compartment.

10. The laundry treatment appliance according to claim 1, wherein the at least one compartment comprises a first compartment and a second compartment, and wherein the at least one treatment agent management function comprises at least one between first and second treatment agent control functions, wherein:

in the first treatment agent control function, the at least one treatment agent dose drawn up by the at least one metering device comprises, during the laundry treatment cycle, a first treatment agent dose drawn up from the first compartment and a second treatment agent dose drawn up from the second compartment;

in the second treatment agent control function, during the laundry treatment cycle the at least one metering device is caused to draw up the at least one treatment agent dose from the first compartment or from the second compartment.

11. The laundry treatment appliance according to claim 10, wherein in the first treatment agent control function the first and second treatment agent doses are determined as respective amount of first and second types of laundry treatment agent, respectively, to be delivered to the laundry load during the laundry treatment cycle.

12. The laundry treatment appliance according to claim 10, wherein in the first treatment agent control function the first and second treatment agent doses are determined as respective partial amounts of a same type of treatment agent to be delivered to the laundry load during the laundry treatment cycle.

13. The laundry treatment appliance according to claim 10, wherein in the second treatment agent control function the at least one treatment agent dose is drawn up from the first compartment or from the second compartment according to one or more parameters of the laundry treatment cycle and/or one or more properties of the laundry load.

14. The laundry treatment appliance according to claim 1, wherein upon enabling of the at least one input selector to allow the selection of said at least one treatment agent management function, said at least one function is discretionally selectable by the user through the at least one input selector or through the external device.

15. A laundry treatment appliance comprising:

at least one compartment configured to contain multiple doses of a treatment agent;

at least one metering device configured to draw up from the at least one compartment at least one treatment agent dose to be delivered to a laundry load to be treated during a laundry treatment cycle;

a user interface comprising at least one input selector configured to, when the at least one input selector is enabled by a user, allow user selection of at least one treatment agent management function, the at least one treatment agent management function affecting the drawing up of the at least one treatment agent dose by the at least one metering device, and a communication interface configured to allow a communication relationship between the laundry treatment appliance and an external user device, the communication interface being configured to receive from the external device enablement commands enabling the at least one input selector to allow the user selection of the at least one treatment agent management function, wherein, without enabling of the at least one input selector to allow the selection of said at least one treatment agent management function, the at least one treatment agent management function is made non-selectable through the external device, and wherein the at least one treatment agent management function comprises one or more of treatment agent dose, treatment agent type, and/or treatment agent control function.

16. The laundry treatment appliance of claim 15, wherein the at least one compartment comprises a first compartment and a second compartment.

17. The laundry treatment appliance of claim 16, wherein the at least one metering device comprises a first metering device and a second metering device, and wherein the first metering device is configured to draw up at least one treatment agent dose from the first compartment and the second metering device is configured to draw up at least one treatment agent dose from the second compartment.

18. The laundry treatment appliance of claim 16, wherein the at least one treatment agent management function is a treatment agent control function that, during the laundry treatment cycle, causes the first metering device to draw up a first treatment agent dose from the first compartment and the second metering device to draw up a second treatment agent dose from the second compartment.

19. The laundry treatment appliance of claim 18, wherein the first treatment agent dose and the second treatment agent dose are different.

20. The laundry treatment appliance of claim 16, wherein the at least one treatment agent management function is a treatment agent control function that, during the laundry treatment cycle, causes the first metering device to draw up a first treatment agent dose from the first compartment or the second metering device to draw up a second treatment agent dose from the second compartment.

* * * * *